US010390607B2

(12) United States Patent
Davies-Smith et al.

(10) Patent No.: US 10,390,607 B2
(45) Date of Patent: Aug. 27, 2019

(54) LIQUID SUPPLY APPARATUS AND PERSONAL CARE IMPLEMENT CONTAINING THE SAME

(71) Applicant: Colgate-Palmolive Company, New York, NY (US)

(72) Inventors: Leighton Davies-Smith, Lebanon, NJ (US); Al Aquanza Sprosta, Maplewood, NJ (US); Shyamala Pillai, Hillsborough, NJ (US)

(73) Assignee: Colgate-Palmolive Company, New York, NY (US)

( * ) Notice: Subject to any disclaimer, the term of this patent is extended or adjusted under 35 U.S.C. 154(b) by 77 days.

(21) Appl. No.: 15/840,766

(22) Filed: Dec. 13, 2017

(65) Prior Publication Data

US 2018/0168329 A1 Jun. 21, 2018

Related U.S. Application Data

(60) Provisional application No. 62/436,793, filed on Dec. 20, 2016.

(51) Int. Cl.
*A46B 11/04* (2006.01)
*A46B 11/00* (2006.01)
(Continued)

(52) U.S. Cl.
CPC ..... *A46B 11/0079* (2013.01); *A46B 9/04* (2013.01); *A46B 11/002* (2013.01);
(Continued)

(58) Field of Classification Search
CPC ..... A46B 11/002; A46B 11/0062; A46B 11/0072; A46B 11/0079; A46B 2200/1066
(Continued)

(56) References Cited

U.S. PATENT DOCUMENTS 1,973,212 A 9/1934 Krueger
3,741,668 A 6/1973 Danjzcek et al.
(Continued)

FOREIGN PATENT DOCUMENTS

CN 2382559 6/2000
DE 2754338 6/1979
(Continued)

OTHER PUBLICATIONS

International Search Report and Written Opinion of the International Searching Authority in International Application No. PCT/US2017/066135, dated Mar. 26, 2018.

*Primary Examiner* — Jennifer C Chiang

(57) ABSTRACT

A liquid supply apparatus with leakage protection. The apparatus includes a housing defining a storage cavity having a total volume including a liquid portion and a gas portion. The storage cavity extends along a cavity axis. A capillary member is fluidly coupled with the liquid to transport the liquid to the external atmosphere. The apparatus includes a plurality of vents that prevent liquid from flowing therethrough while permitting air to pass therethrough. A hub component is mounted within the storage cavity and it includes a plurality of radial vent passageways extending between the storage cavity and a primary vent passageway, which in turn forms a pathway to the external atmosphere. The vents may be located and arranged such that irrespective of inclination and rotational orientation of the housing relative to a gravitational vector at least one of the vents is in spatial communication with the gas.

20 Claims, 13 Drawing Sheets

(51) Int. Cl.
*B05C 1/00* (2006.01)
*A46B 9/04* (2006.01)
*A46B 15/00* (2006.01)

(52) U.S. Cl.
CPC ..... *A46B 11/0062* (2013.01); *A46B 15/0051* (2013.01); *B05C 1/00* (2013.01); *A46B 2200/1066* (2013.01)

(58) Field of Classification Search
USPC ..... 401/198, 270
See application file for complete search history.

(56) References Cited

U.S. PATENT DOCUMENTS

| | | | |
|---|---|---|---|
| 4,155,663 | A | 5/1979 | Cerquozzi |
| 4,207,012 | A | 6/1980 | Kuparinen |
| 4,530,369 | A | 7/1985 | Adams |
| 4,753,546 | A | 6/1988 | Witz et al. |
| 4,770,558 | A | 9/1988 | Frietsch |
| 4,886,389 | A | 12/1989 | Vidovic |
| 5,033,898 | A | 7/1991 | Williams |
| 5,062,728 | A | 11/1991 | Kuo |
| 5,096,319 | A | 3/1992 | Gueret |
| 5,098,297 | A | 3/1992 | Chari et al. |
| D337,659 | S | 7/1993 | Lacy |
| 5,242,233 | A | 9/1993 | Sirota |
| 5,611,687 | A | 3/1997 | Wagner |
| 6,345,405 | B1 | 2/2002 | Brackin |
| 6,371,674 | B1 | 4/2002 | Lerner |
| 6,416,242 | B1 | 7/2002 | Kaufmann |
| 6,699,038 | B2 | 3/2004 | Stewart |
| 7,887,246 | B2 | 2/2011 | Hori |
| 8,398,326 | B2 | 3/2013 | Jimenez et al. |
| 8,529,150 | B2 | 9/2013 | Olson |
| 9,237,798 | B2 | 1/2016 | Jimenez et al. |
| 9,648,943 | B2 | 5/2017 | Jimenez et al. |
| 9,700,130 | B2 * | 7/2017 | Kennedy ..... A46B 15/0061 |
| 2002/0192007 | A1 | 12/2002 | Lee |
| 2004/0237226 | A1 | 12/2004 | Hohlbein et al. |
| 2004/0255416 | A1 | 12/2004 | Hohlbein |
| 2008/0014010 | A1 | 1/2008 | Bartschi et al. |
| 2017/0215574 | A1 | 8/2017 | Jimenez et al. |

FOREIGN PATENT DOCUMENTS

| | | |
|---|---|---|
| DE | 40 14642 | 4/1991 |
| DE | 100 35 214 | 2/2002 |
| EP | 0624483 | 11/1994 |
| EP | 1 017 297 | 6/2002 |
| FR | 2 448 982 | 9/1980 |
| GB | 801603 | 9/1958 |

* cited by examiner

LIQUID SUPPLY APPARATUS AND PERSONAL CARE IMPLEMENT CONTAINING THE SAME

CROSS-REFERENCE TO RELATED APPLICATIONS

The present application claims the benefit of U.S. Provisional Application Ser. No. 62/436,793, filed Dec. 20, 2016, the entirety of which is incorporated herein by reference.

BACKGROUND

Liquid supply apparatuses are used to store a liquid that is later dispensed onto a surface. Examples of liquid supply apparatuses include writing instruments, liquid dispensers, liquid applicators, and the like. Personal care implements, particularly oral care implements such as toothbrushes, are typically used by applying dentifrice or toothpaste to tooth cleaning elements such as bristles followed by brushing regions of the oral cavity, e.g., the teeth, tongue, and/or gums. Some oral care implements have been equipped with liquid reservoirs and systems for dispensing auxiliary oral care liquids before and/or during the tooth brushing regimen. An issue with existing liquid supply apparatuses and personal care implements containing the same is leakage, particularly due to air expansion as a result of temperature increases or pressure decreases which forces the liquid to leak out of the device. An improved liquid supply apparatus and personal/oral care implement containing the same is desired to address existing unwanted liquid leaks.

BRIEF SUMMARY

The present invention is directed to a liquid supply apparatus with leakage protection. The apparatus includes a housing defining a storage cavity having a total volume including a liquid portion and a gas portion. The storage cavity extends along a cavity axis. A capillary member is fluidly coupled with the liquid to transport the liquid to the external atmosphere. The apparatus includes a plurality of vents that prevent liquid from flowing therethrough while permitting air to pass therethrough. A hub component is mounted within the storage cavity and it includes a plurality of radial vent passageways extending between the storage cavity and a primary vent passageway, which in turn forms a pathway to the external atmosphere. The vents may be located and arranged such that irrespective of inclination and rotational orientation of the housing relative to a gravitational vector at least one of the vents is in spatial communication with the gas.

In one aspect, the invention may be a liquid supply apparatus comprising: a housing defining a storage cavity having a total volume, the storage cavity extending along a cavity axis from a first end to a second end; a store of a liquid in the storage cavity and occupying a portion of the total volume, a remaining portion of the total volume occupied by a gas; a capillary member in liquid coupling with the store of the liquid, the capillary member extending through the housing and configured to transport the liquid from the store to an external atmosphere via capillary action; a plurality of vents, each of the vents configured such that the liquid cannot flow therethrough at ambient temperature and pressure equilibrium between the storage cavity and the external atmosphere, the vents comprising a plurality of radial vent passageways; a hub component mounted within the storage cavity; the hub component comprising the radial vent passageways, each of the radial vent passageways extending between the storage cavity and a primary vent passageway, the primary vent passageway forming a pathway between each of the radial vent passageways and the external atmosphere; and the vents located and arranged such that irrespective of inclination and rotational orientation of the housing relative to a gravitational vector at least one of the vents is in liquid communication with the gas.

In another aspect, the invention may be a liquid supply apparatus comprising: a housing defining a storage cavity extending along a cavity axis from a first end to a second end; a capillary member extending through the housing and configured to transport liquid via capillary action; a hub component mounted within the storage cavity, the hub component comprising radial vent passageways, each of the radial vent passageways extending between the storage cavity and a primary vent passageway, the primary vent passageway forming a pathway between each of the radial vent passageways and an external atmosphere; at least one upper vent adjacent the first end of the storage cavity; and at least one lower vent located adjacent the second end of the storage cavity The liquid supply apparatus may be located within a handle of a personal care implement so that an applicator of the personal care implement is fluidly coupled to the capillary member.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
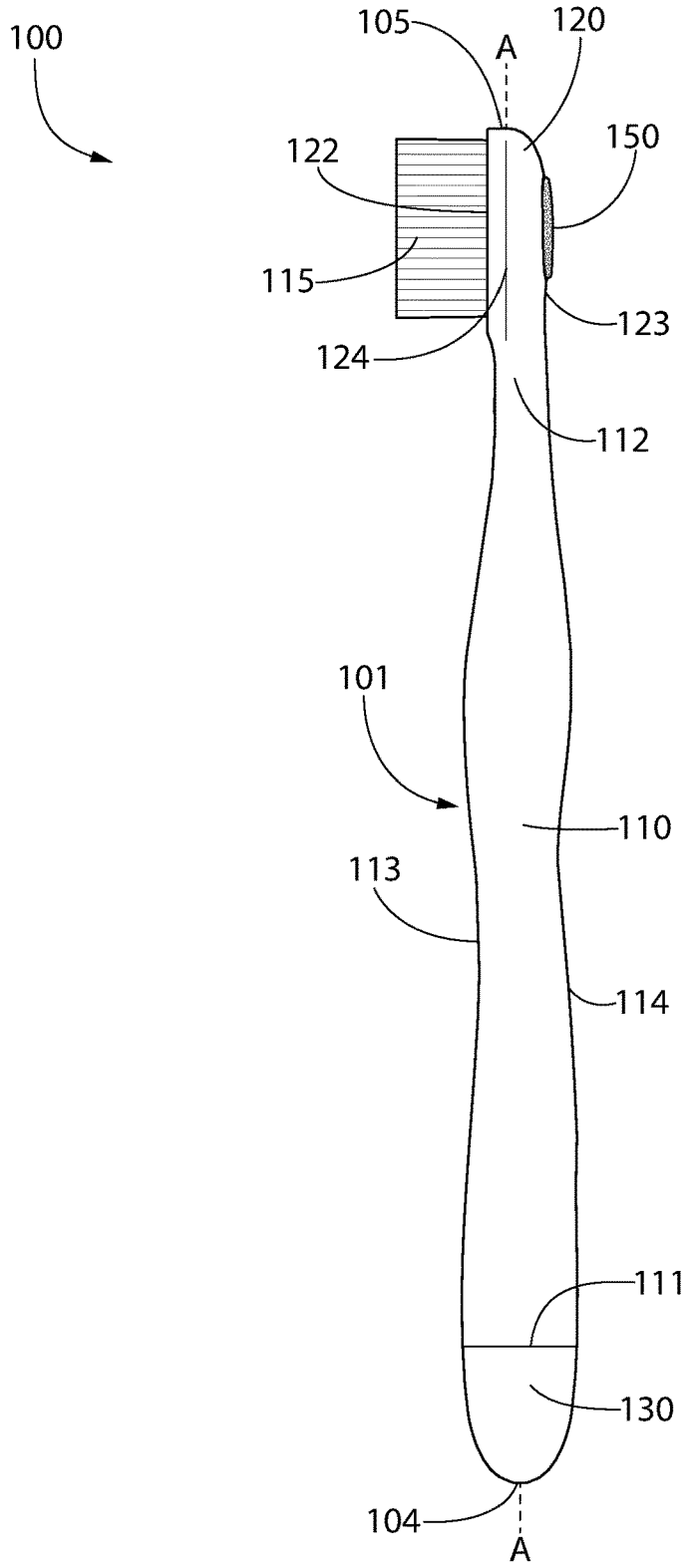
FIG. 1 is side view of a personal care implement in accordance with an embodiment of the present invention.
Figure 2:
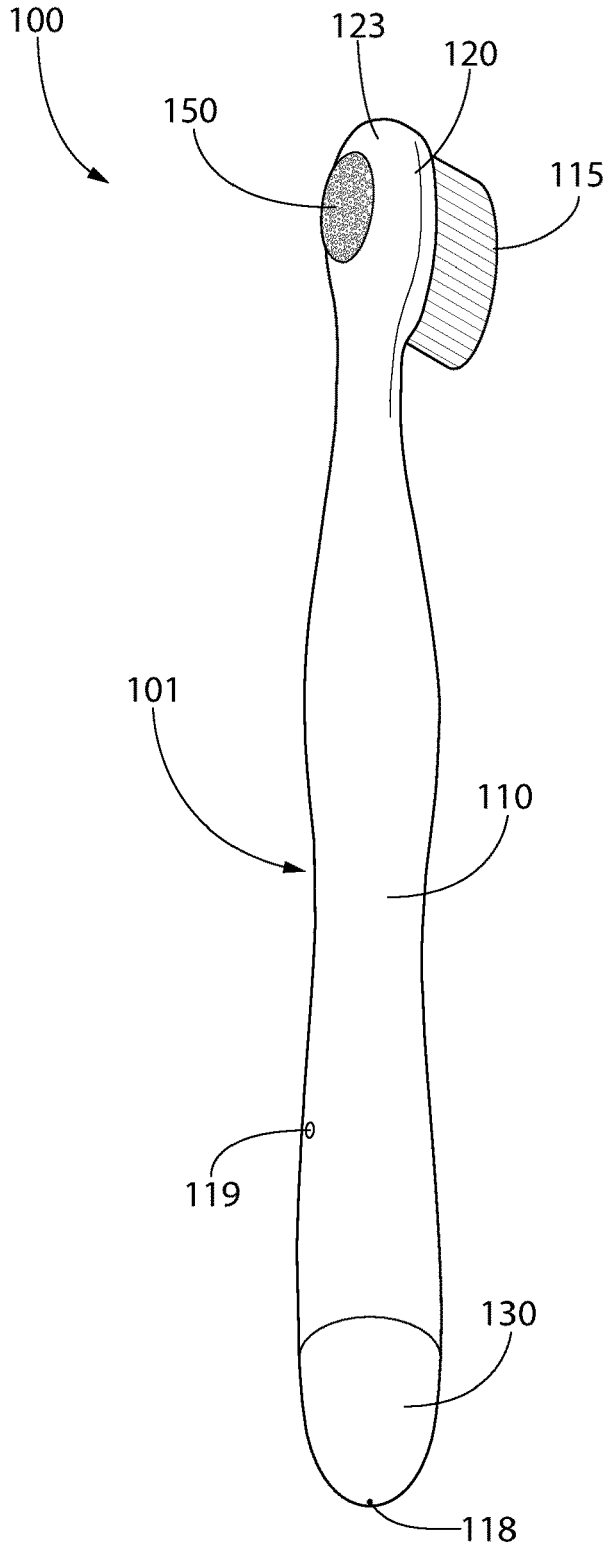
FIG. 2 is a rear perspective view of the personal care implement of FIG. 1.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Referring first to FIGS. 1-5, a personal care implement 100 is illustrated with a liquid supply apparatus 200 coupled thereto in accordance with an embodiment of the present invention. In certain embodiments the liquid supply apparatus 200 may be a stand-alone apparatus that operates independently of the personal care implement 100 and in other embodiments the liquid supply apparatus 200 may be used in conjunction with the personal care implement 100. In certain embodiments, the personal care implement 100 may comprise the liquid supply apparatus 200.

The liquid supply apparatus 200, or the personal care implement 100 comprising the same, is designed to store a liquid and to dispense the liquid onto a desired surface. The liquid supply apparatus 200 includes mechanisms that facilitate flow of the liquid from its stored location to another location at which the liquid is dispensed in a desired manner. As described more fully herein, the liquid supply apparatus 200 is specifically configured to prevent (or severely limit) liquid leakage regardless of the orientation at which the liquid supply apparatus 200 is held under any normal usage and storage conditions including through changes in temperature and pressure. Although described herein as being a part of a personal care implement, the invention is not to be so limited and the liquid supply apparatus 200 may be a stand-alone device that is not tied to a particular product type or it may be formed as a part of a different type of product.

In the exemplified embodiment, the personal care implement 100 is an oral care implement, and more specifically a manual toothbrush. Thus, the invention will be described herein with the details predominately directed to a toothbrush. However, in certain other embodiments the personal care implement 100 can take on other forms such as being a powered toothbrush, a tongue scraper, a gum and soft tissue cleanser, a water pick, an interdental device, a tooth polisher, a specially designed ansate implement having tooth engaging elements, or any other type of implement that is commonly used for oral care. Still further, the personal care implement 100 may not be one that is specifically used for oral care in all embodiments, but rather it may be an implement such as a deodorant application implement, a face or body cleaning implement, a make-up applicator implement, a razor or shaving implement, a hairbrush, or the like. Thus, it is to be understood that the inventive concepts discussed herein can be applied to any type of personal care implement unless a specific type of personal care implement is specified in the claims. Furthermore, in some embodiments the invention is directed solely to the liquid supply apparatus 200. Thus, the liquid supply apparatus 200 may be included as a part of the personal care implement 100 or it may be a separate, stand-alone device. When a stand-alone device, the liquid supply apparatus 200 may include some type of applicator so that the liquid dispensed from the liquid supply apparatus 200 can be properly applied to a desired surface.

In the exemplified embodiment, the personal care implement 100 generally includes a body 101 comprising a handle 110 and a head 120 and an end cap 130 that is detachably coupled to the handle 110. The personal care implement 100 generally extends along a longitudinal axis A-A from a proximal end 104 to a distal end 105. Conceptually, the longitudinal axis A-A is a reference line that is generally coextensive with the three-dimensional center line of the body 101. Because the body 101 may, in certain embodiments, be a non-linear structure, the longitudinal axis A-A of the body 101 may also be non-linear in certain embodiments. However, the invention is not to be so limited in all embodiments and in certain other embodiments the body 101 may have a simple linear arrangement and thus a substantially linear longitudinal axis A-A.

The handle 110 extends from a proximal end 111 to a distal end 112 and the head 120 is coupled to the distal end 112 of the handle 110. In the exemplified embodiment, the end cap 130 is detachably coupled to the proximal end 111 of the handle 120. Specifically, the handle 120 has an opening 116 at the proximal end 111 thereof and the end cap 130 is coupled to the proximal end 111 of the handle 120 and closes the opening 116. The end cap 130 may be detachable from the handle 120 so that a liquid or oral care material can be stored within the body 101 and can be refilled by detaching the end cap 130 from the handle 110 to provide access, via the opening 116, to a cavity/reservoir in the body 101 within which the liquid may be stored. Furthermore, in certain embodiments the end cap 130 may be altogether omitted and the proximal end 111 of the body 101 may form a closed bottom end of the personal care implement 100. In such embodiments, refill of the reservoir may not be possible or may occur through other mechanisms/structures as would be understood to persons skilled in the art.

The handle 110 is an elongated structure that provides the mechanism by which the user can hold and manipulate the personal care implement 100 during use. The handle 110 comprises a front surface 113 and an opposing rear surface 114. In the exemplified embodiment, the handle 110 is generically depicted having various contours for user comfort. Of course, the invention is not to be so limited in all embodiments and in certain other embodiments the handle 110 can take on a wide variety of shapes, contours and configurations, none of which are limiting of the present invention unless so specified in the claims.

In the exemplified embodiment, the handle 110 is formed of a rigid plastic material, such as, for example without limitation, polymers and copolymers of ethylene, propylene, butadiene, vinyl compounds, and polyesters such as polyethylene terephthalate. Of course, the invention is not to be so limited in all embodiments and the handle 110 may include a resilient material, such as a thermoplastic elastomer, as a grip cover that is molded over portions of or the entirety of the handle 110 to enhance the gripability of the handle 110 during use. For example, portions of the handle 110 that are typically gripped by a user's palm during use may be overmolded with a thermoplastic elastomer or other resilient material to further increase comfort to a user.

The head 120 of the personal care implement 100 is coupled to the handle 110 and comprises a front surface 122, an opposing rear surface 123, and a peripheral surface 124 extending between the front and rear surfaces 122, 123. In the exemplified embodiment, the head 120 is formed integrally with the handle 110 as a single unitary structure using a molding, milling, machining or other suitable process. However, in other embodiments the handle 110 and the head 120 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. In some embodiments the head 120 may be detachable from the handle 110. The head 120 may be formed of any one of the materials discussed above with regard to the handle 110.

In the exemplified embodiment, the head 120 of the personal care implement 100 is provided with a plurality of tooth cleaning elements 115 extending from the front surface 122. Of course, depending on the particular type of device selected for the personal care implement 100, the tooth cleaning elements 115 may be replaced with some other bristle-like elements (for example when the personal care implement 100 is a hairbrush or a mascara applicator) or may be altogether omitted.

In the exemplified embodiment the tooth cleaning elements 115 are generically illustrated. In certain embodiments the exact structure, pattern, orientation and material of the tooth cleaning elements 115 are not to be limiting of the present invention. Thus, the term "tooth cleaning elements" is used herein in a generic sense to refer to any structure that can be used to clean, polish or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof, and/or structures containing such materials or combinations. Suitable elastomeric materials include any biocompatible resilient material suitable for uses in an oral hygiene apparatus. To provide optimum comfort as well as cleaning benefits, the elastomeric material of the tooth or soft tissue engaging elements has a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

Figure 3:
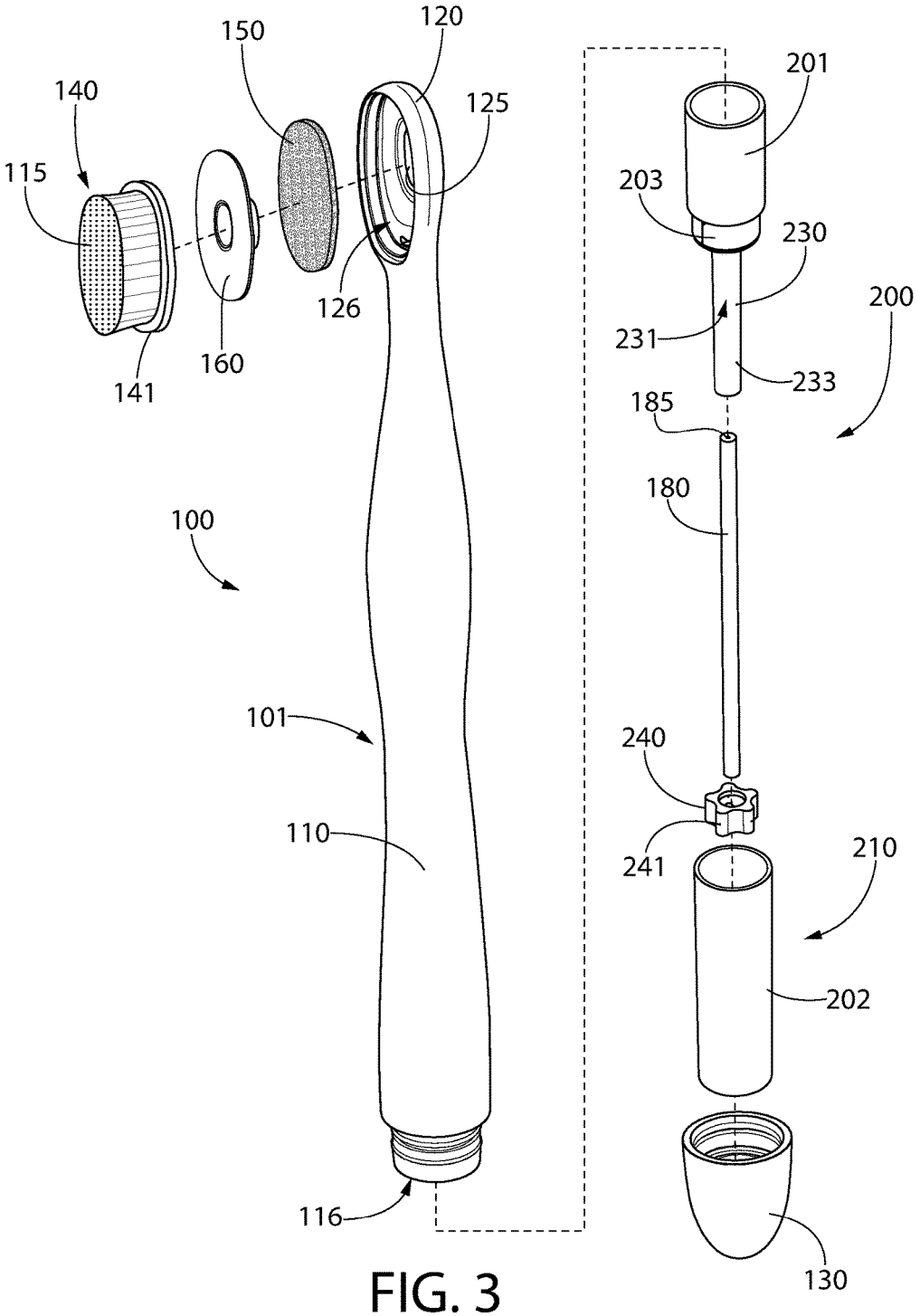
FIG. 3 is an exploded front perspective view of the personal care implement of FIG. 1 illustrating a liquid supply apparatus exploded from a body of the personal care implement.
Figure 4:
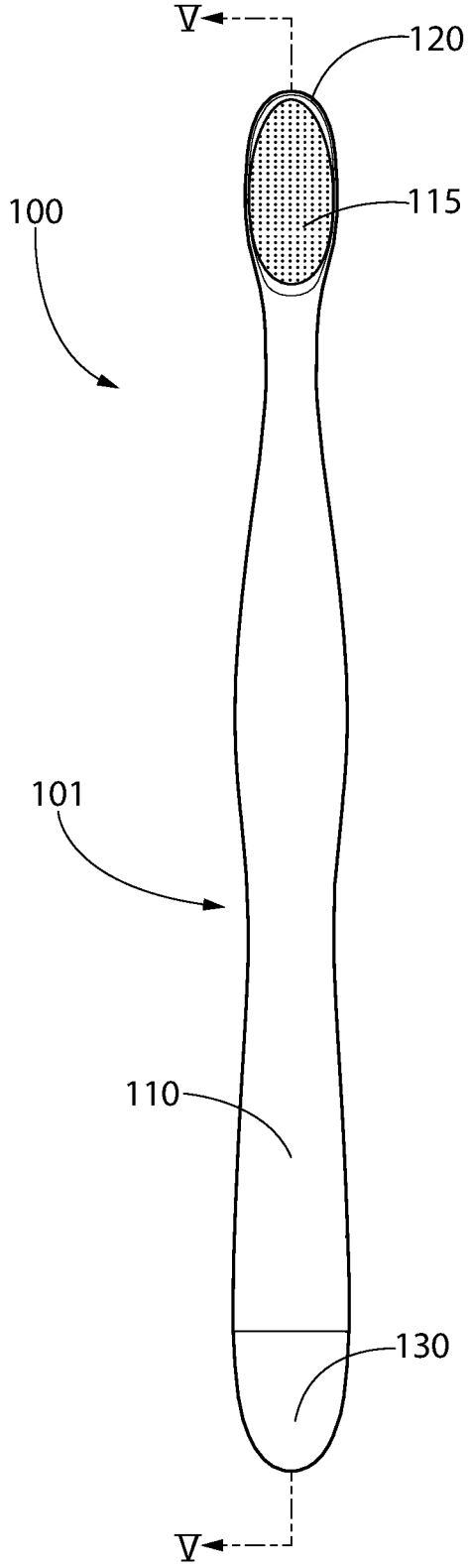
FIG. 4 is a front view of the personal care implement of FIG. 1.
Figure 5:
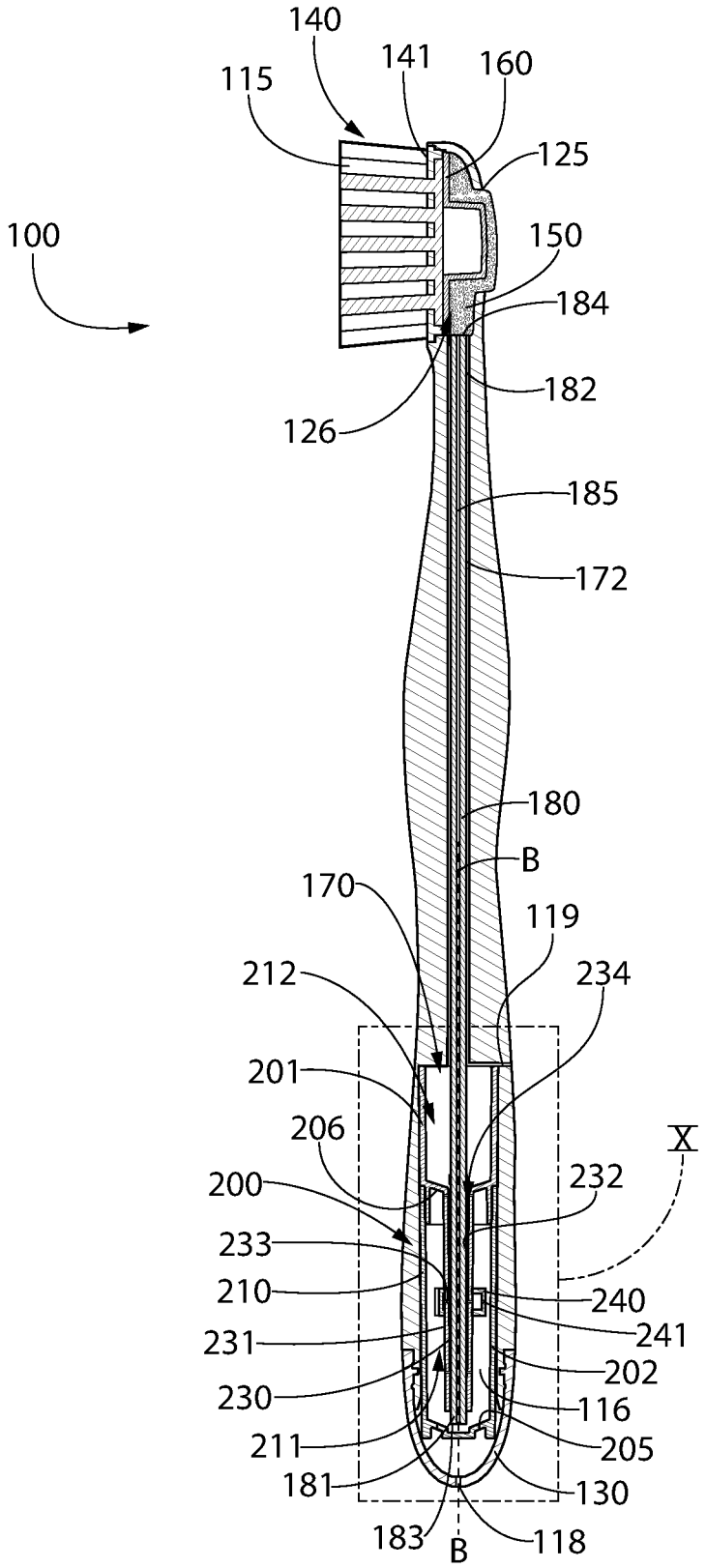
FIG. 5 is a cross-sectional view taken along line V-V of FIG. 4 illustrating the liquid supply apparatus located within the body of the personal care implement.
Figure 6:
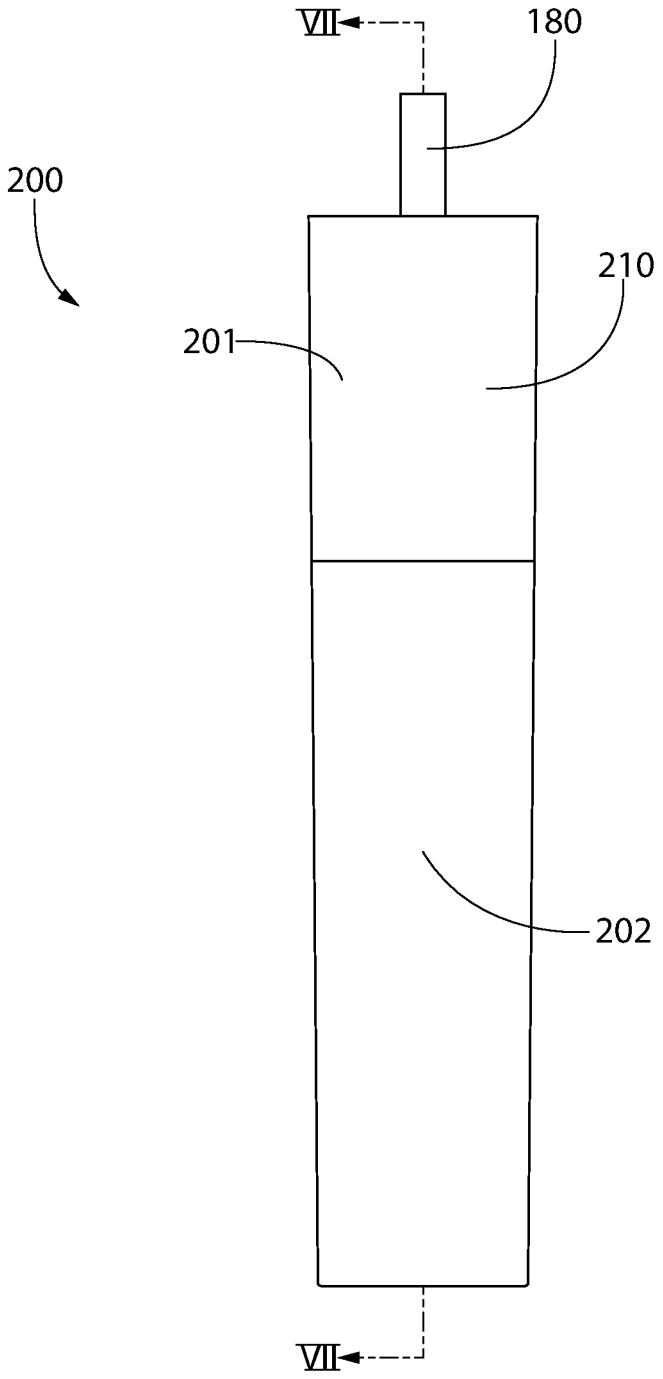
FIG. 6 is a front view of the liquid supply apparatus of FIG. 3.

Referring briefly to FIGS. 3 and 5, in the exemplified embodiment the tooth cleaning elements 115 are formed on a cleaning element assembly 140 that comprises a head plate 141 and the tooth cleaning elements 115 mounted thereon. In such an embodiment, the head plate 141 is a separate and distinct component from the body 101 of the personal care implement 100. However, the head plate 141 is connected to the body 101 at a later stage of the manufacturing process by any suitable technique known in the art, including without limitation thermal or ultrasonic welding, any fusion techniques such as thermal fusion, melting, a tight-fit assembly, a coupling sleeve, threaded engagement, adhesion, or fasteners. Thus, the head plate 141 and the body 101 are separately formed components that are secured together during manufacture of the personal care implement 100. More specifically, the tooth cleaning elements 115 are secured to the head plate 141 in a manner known in the art (i.e., anchor free tufting or AFT) to form the cleaning element assembly 140, and then the cleaning element assembly 140 is coupled to the head 120. Alternatively, the tooth cleaning elements 115 may be connected to the head 120 using AMR techniques, stapling, or the like. The invention is not to be particularly limited by the manner in which the tooth cleaning elements 115 are coupled to the head 120 in all embodiments.

Although not illustrated herein, in certain embodiments the head 120 may also include a soft tissue cleanser coupled to or positioned on its rear surface 123. An example of a suitable soft tissue cleanser that may be used with the present invention and positioned on the rear surface 123 of the head 120 is disclosed in U.S. Pat. No. 7,143,462, issued Dec. 5, 2006 to the assignee of the present application, the entirety of which is hereby incorporated herein by reference. In certain other embodiments, the soft tissue cleanser may include protuberances, which can take the form of elongated ridges, nubs, or combinations thereof. Of course, the invention is not to be so limited and in certain embodiments the personal care implement 100 may not include any soft tissue cleanser.

Referring again to FIGS. 1-5 concurrently, in the exemplified embodiment the personal care implement 100 comprises an applicator 150 protruding from the rear surface 123 of the head 120. More specifically, the head 120 has an opening 125 that extends from the rear surface 123 of the head 120 into a basin cavity 126 of the head 120. The applicator 150 is inserted into the basin cavity 126 of the head 120 and extends through the opening 125 and protrudes from the rear surface 123 of the head 120. Thus, during use of the personal care implement 100 to brush teeth, the applicator 150 will engage/contact the user's oral surfaces and dispense a liquid that is loaded on the applicator 150 onto the oral surface as discussed in more detail below. The personal care implement 100 may also include a divider member 160 that divides the basin cavity 126 into an upper chamber and a lower chamber such that the cleaning element assembly 140 is located in the upper chamber and the applicator 150 is located in the lower chamber. The divider member 160 may seal the applicator 150 within the lower chamber so that any liquid loaded on the applicator 150 does not pass into the upper chamber.

The applicator 150 may be formed of a capillary material that is capable of being loaded with a liquid that can be dispensed from the applicator 150 when the applicator 150 is compressed. For example, the applicator 150 may be a porous foam such as including without limitation a polyurethane foam or other open cell porous material. Thus, in the exemplified embodiment the applicator 150 can be formed of any type of material through which a liquid can travel via capillary action or capillary flow. Specifically, the capillary material can be a porous material, a fibrous material, a foam material, a sponge material, natural fibers, sintered porous materials, porous or fibrous polymers or other materials which conduct the capillary flow of liquids. Of course, the capillary material is not to be limited by the specific materials noted herein in all embodiments, but can be any material that facilitates movement of a liquid therethrough via capillary action. Furthermore, although described herein as being formed of a capillary material, the invention is not to be so limited in all embodiments and some alternative embodiments will be described herein below. For example, in certain embodiments the applicator 150 may be formed of a plastic material or a rubber material and may have an orifice formed therethrough to enable the liquid to flow through the applicator for application to a biological surface such as a user's oral cavity, facial surfaces, or the like.

Referring to FIGS. 3 and 5-9 concurrently, the liquid supply apparatus 200 will be described in more detail. The liquid supply apparatus 200 generally comprises a housing 210 having an inner surface 209 that defines a storage cavity 211 and a venting cavity 212, a hub component 240 mounted within the storage cavity 211, and a capillary member 180 extending through the storage and venting cavities 211, 212 of the housing 210. In the exemplified embodiment the housing 210 is a separate component from the personal care implement 100 that is insertable into a handle cavity 170 of the personal care implement 100. However, in other embodiments portions of the housing 210 may be formed by the body 101 of the personal care implement 100 rather than having a separate insertable housing 210.

The storage cavity 211 is for storing a liquid that is dispensed via the applicator 150 as described herein. The venting cavity 212 is spatially coupled to the storage cavity 211 as described in more detail below and it is the location through which air/gas can be vented from the storage cavity 211 to the external environment or vice versa as needed to ensure acceptable flow of the liquid while eliminating the potential for leaks. Although air/gas can pass from the storage cavity 211 to the venting cavity 212 as described herein, liquid stored in the storage cavity 211 cannot pass/flow into the venting cavity 212 under normal usage conditions. The capillary member 180 promotes the flow and transport of the liquid from the storage cavity 211 to the applicator 150 or other location where it can be dispensed and applied onto a desired surface.

The storage cavity 211 extends along a cavity axis B-B from a first end 205 to a second end 206. More specifically, the storage cavity 211 has a floor 207 at the first end 205 thereof and a roof 208 at the second end 206 thereof. Thus, the floor 207 forms a lower boundary of the storage cavity 211, the roof 208 forms an upper boundary of the storage cavity 211, and the inner surface 209 of the housing 210 forms the remaining boundary of the storage cavity 211. The roof 208 separates the storage cavity 211 from the venting cavity 212.

The capillary member 180 is designed to flow or otherwise transport the liquid from the storage cavity 211 to the applicator 150 or other desired location for dispensing onto a desired surface. The capillary member 180 extends from a first end 183 that is located within the storage cavity 211 and fluidly coupled to the liquid stored in the storage cavity 211 to a second end 184 that is fluidly coupled to the applicator 150. The capillary member 180 may extend along the cavity axis B-B or it may be offset therefrom.

The capillary member 180 is at least partially located within the storage cavity 211 so that the capillary member 180 is fluidly coupled to the store of the liquid that is located within the storage cavity 211. Specifically, the capillary member 180 has a first portion 181 that includes the first end 183 that is located within the storage cavity 211. The capillary member 180 extends from the housing 210 and through a passageway 172 in the personal care implement 100 to the applicator 150 so that the capillary member 180 can draw liquid from the store of the liquid in the storage cavity 211 and transport that liquid to the applicator 150 where it can be dispensed at an appropriate time and location.

In the exemplified embodiment, the capillary member 180 is a capillary tube having a capillary passageway 185 extending entirely through the capillary member 180 from the first end 183 to the second end 184 that permits the liquid to flow within the capillary member 180 from the first end 183 to the second end 184 via a wicking action. Thus, in this manner the liquid is able to flow from its storage location within the storage cavity 211 of the housing 210 to the applicator 150 so that the applicator 150 can be loaded with the liquid. Specifically, the passageway 185 may have a cross-sectional size and shape that permits flow of the liquid all the way from the storage cavity 211 to the applicator 150 to ensure that the applicator 150 remains loaded with the liquid. As some of the liquid is dispensed from the applicator 150, the capillary member 180 transports an additional amount of the liquid to the applicator 150.

In other embodiments, the capillary member 180 may be formed of a porous material, such as any of the materials described above with reference to the applicator 150. In such embodiments the liquid may flow up the capillary member 180 via a wicking action (also referred to herein as capillary action) due to the material of the capillary member 180 (for example if the capillary member 180 is formed from a porous material). In either embodiment, the flow of the liquid occurs naturally via capillary action without the need for a separate pump.

In certain embodiments, the capillary member 180 has a capillary structure which may be formed in numerous configurations and from numerous materials operable to produce fluid flow via capillary action. In one non-limiting embodiment, the capillary member 180 may be configured as a tube or lumen having an internal open capillary passageway extending between ends of the capillary member which is configured and dimensioned in cross section to produce capillary flow. The lumen or open capillary passageway may have any suitable cross sectional shape and configuration. In such embodiments the capillary member 180 may be formed of a porous material as described below or a non-porous material (e.g., plastics such as polypropylene, metal, rubber, or the like). In other non-limiting embodiments, capillary member 180 may be formed of a porous and/or fibrous material of any suitable type through which a fluid can travel via capillary action or flow. Examples of suitable materials include without limitation fibrous felt materials, ceramics, and porous plastics with open cells (e.g. polyurethane, polyester, polypropylene, or combinations thereof) including such materials as those available from Porex Technologies, Atlanta, Ga. The capillary member material may therefore be a porous material, a fibrous material, a foam material, a sponge material, natural fibers, sintered porous materials, porous or fibrous polymers or other materials which conduct the capillary flow of liquids. Of course, the capillary material is not to be limited by the specific materials noted herein in all embodiments, but can be any material that facilitates movement of a liquid therethrough via capillary action. A mixture of porous and/or fibrous materials may be provided which have a distribution of larger and smaller capillaries. The capillary member 180 can be formed from a number of small capillaries that are connected to one another, or as a larger single capillary rod. The capillary member whether formed as a lumen or of porous or fibrous materials may have any suitable polygonal or non-polygonal cross sectional shape including for example without limitation circular, elliptical, square, triangular, hexagonal, star-shaped, etc. The invention is not limited by the construction, material, or shape of the capillary member.

In the exemplified embodiment, the capillary member 180 has openings into the passageway 185 only at the first end 183 thereof and at the second end 184 thereof. There are no other openings along the length of the capillary member 180 that permit the liquid to enter into the passageway 185 of the capillary member 180. Thus, the liquid within the storage cavity 211 can only enter into the passageway 185 of the capillary member 180 through the opening in the first end 183 of the capillary member 180. Thus, in certain orientations of the housing 210 and certain liquid levels within the storage cavity 211, the liquid is unable to enter into the passageway 185 of the capillary member 180 because it is not in contact with the opening in the first end 183 of the capillary member 180. Of course, in other embodiments additional openings may be provided in the capillary member 180 through which liquid can enter into the passageway 185 of the capillary member 180.

In the exemplified embodiment the housing 210 is formed of a first housing component 201 and a second housing component 202. Furthermore, the first housing component 201 has a flange 203 that is insertable into the second housing component 202 to couple the upper and lower parts 201, 202 together via an interference or friction fit, although other mechanisms for coupling the upper and lower parts 201, 202 of the housing 210 together may also be used in other embodiments (adhesive, engaging threaded surfaces, or the like). Of course, the flange 203 could be on the second housing component 202 rather than the first housing component 201. It may also be possible to form the housing 210 as a single part in other embodiments.

In the exemplified embodiment, the housing 210 is a separate component from the handle 110 of the personal care implement 100. For example, in one embodiment the housing 210 could be a stand-alone device such as a cartridge that is insertable into the handle cavity 170 of the handle 110 of the personal care implement 100. In such an embodiment the housing 210 would not form any portion of the handle 110, but rather it would be wholly retained therein. In another embodiment the housing 210 could be a stand-alone device that operates independently without being inserted into any separate product (such as the personal care implement 100). Thus, the housing 210 could include all features for storing the liquid and it may be coupled to or include additional features, such as an applicator, for applying the liquid to a desired surface without being coupled to or forming a part of a personal care implement. However, in other embodiments the housing 210 may form a portion of the handle 110 of the personal care implement 100.

The liquid supply apparatus 200 is designed to permit air to replace liquid that is dispensed from the storage cavity 211 during use to ensure consistent liquid flow and to vent the storage cavity 211 to prevent air from expanding within the storage cavity 211 and causing the liquid to leak out in an undesired manner. Specifically, increases in temperature and decreases in pressure cause air to expand, and if air expands within the storage cavity 211 without being vented it will exert a pressure on the liquid in the storage cavity 211 which could result in a leak situation. In the exemplified embodiment this scenario is dealt with by including the liquid supply apparatus 200, which comprises a vent tube 230 and a hub component 240. In the exemplified embodiment, the first housing component 201 comprises the vent tube 230, and the first housing component 201 is coupled to the second housing component 202 so that the vent tube 230 extends into the second housing component 202. Specifically, the second housing component 202 defines the storage cavity 211 and the vent tube 230 extends into the storage cavity 211.

The vent tube 230 has an outer surface 231 and an inner surface 232 that defines a passageway 234 extending along the entire length of the vent tube 230. Specifically, the vent tube 230 extends from a first end 235 adjacent the floor 207 of the storage cavity 211 to an opposite second end 236 adjacent the roof 208 of the storage cavity 211 and the venting cavity 212. In the exemplified embodiment, the passageway 234 of the vent tube 230 is tapered such that its transverse cross-sectional area increases from the first end 235 of the vent tube 230 to the second end 236 of the vent tube 230.

The capillary member 180 extends through the housing 210 within the passageway 234 of the vent tube 230 and protrudes from the second end 236 of the vent tube 230 where it passes into the venting cavity 212 and the passageway 172 to the applicator 150. Although it is located within the passageway 234 of the vent tube 230, an outer surface 189 the capillary member 180 is spaced from the inner surface 232 of the vent tube 230 along at least a portion of its length by an annular gap 186. Specifically, due to the tapering nature of the passageway 234, the vent tube 230 is in contact with the capillary member 180 at the first end 235 of the vent tube 230, but the vent tube 230 is spaced from the capillary member 180 at the second end 236 of the vent tube 230 by the annular gap 186. The transverse cross-sectional area of the annular gap 186 increases from the first end 235 of the vent tube 230 to the second end 236 of the vent tube 230. The annular gap 186 that is formed between the inner surface 232 of the vent tube 230 and the outer surface 189 of the capillary member 180 forms a primary vent passageway 250 of the vent tube 230.

Although in the exemplified embodiment the passageway 234 of the vent tube 230 tapers, the invention is not to be so limited. In other embodiments, the passageway 234 may have a constant transverse cross-sectional area along most of its length, except at the first end 235 of the vent tube 230 where the passageway 234 may have a decreased transverse cross-sectional area. In this manner, the vent tube 230 would still contact the capillary member 180 at the first end 235 and be spaced from the capillary member 180 by the annular gap 186 at locations other than the first end 235, but the transverse cross-sectional area of the annular gap 186 will be constant.

Because the vent tube 230 is in contact with the capillary member 180 at the first end 235 of the vent tube 230, fluids (air and liquid) within the storage cavity 211 are prevented from entering into the annular gap 186 (and into the primary vent passageway 250) at the first end 235 of the vent tube 230. However, the vent tube 230 has a plurality of vent apertures 233 extending from the outer surface 231 of the vent tube 230 to the inner surface 232 of the vent tube 230 that are sized and configured to permit air/gas to pass therethrough. Specifically, each of the vent apertures 233 place the storage cavity 211 into spatial/fluid communication with the primary vent passageway 250 (i.e., with the annular gap 186). Thus, as discussed in more detail below, air/gas is able to pass from the storage cavity 211 into the primary vent passageway 250, and then upwardly within the primary vent passageway 250 to the venting cavity 212 where it can be vented to the external atmosphere via a handle vent aperture 119 (FIG. 5). In certain embodiments the venting cavity 212 may be omitted and the primary vent passageway 250 may be fluidly/spatially coupled directly to the handle vent aperture 119 without first passing through a separate venting cavity.

In the exemplified embodiment the handle vent aperture 119 is oriented orthogonal to the longitudinal axis A-A of the personal care implement 100. However, in other embodiments the handle vent aperture 119 may be oriented oblique to the longitudinal axis A-A of the personal care implement 100 (and to the cavity axis B-B) to limit blockage or by preventing debris from entering into the handle vent aperture 119.

In the exemplified embodiment, the vent apertures 233 are positioned at different axial locations along the length of the vent tube 230. Thus, the vent apertures 233 include at least one lower vent aperture 233*a* adjacent to the first end 205 of the storage cavity 210 and at least one upper vent aperture 233*b* adjacent to the second end 206 of the storage cavity 210. Although the vent apertures 233 are located at three different axial heights along the vent tube 230 in the exemplified embodiment, the invention is not to be so limited and more (or less) vent apertures can be included on the vent tube 230 in other embodiments. In the exemplified embodiment, there is a at least one additional vent aperture 137 formed into the floor 207 of the storage cavity 211 and at least one additional vent aperture 138 formed into the roof 208 of the storage cavity 211. These additional vent apertures 137, 138 may be included to ensure adequate spatial/fluid communication exists between the storage cavity 211 and the external atmosphere as described in more detail herein below with specific reference to FIGS. 10A-10D. Thus, the location of the vent apertures 233, 137, 138 are specifically selected so that irrespective of the inclination (vertical upright, vertical upside-down, tilted at any of various angles, or the like) and rotational orientation of the housing 210 relative to a gravitational vector, at least one of the vent apertures 233, 137, 138 is in fluid communication with a gas or air pocket in the storage cavity 211.

Figure 7:
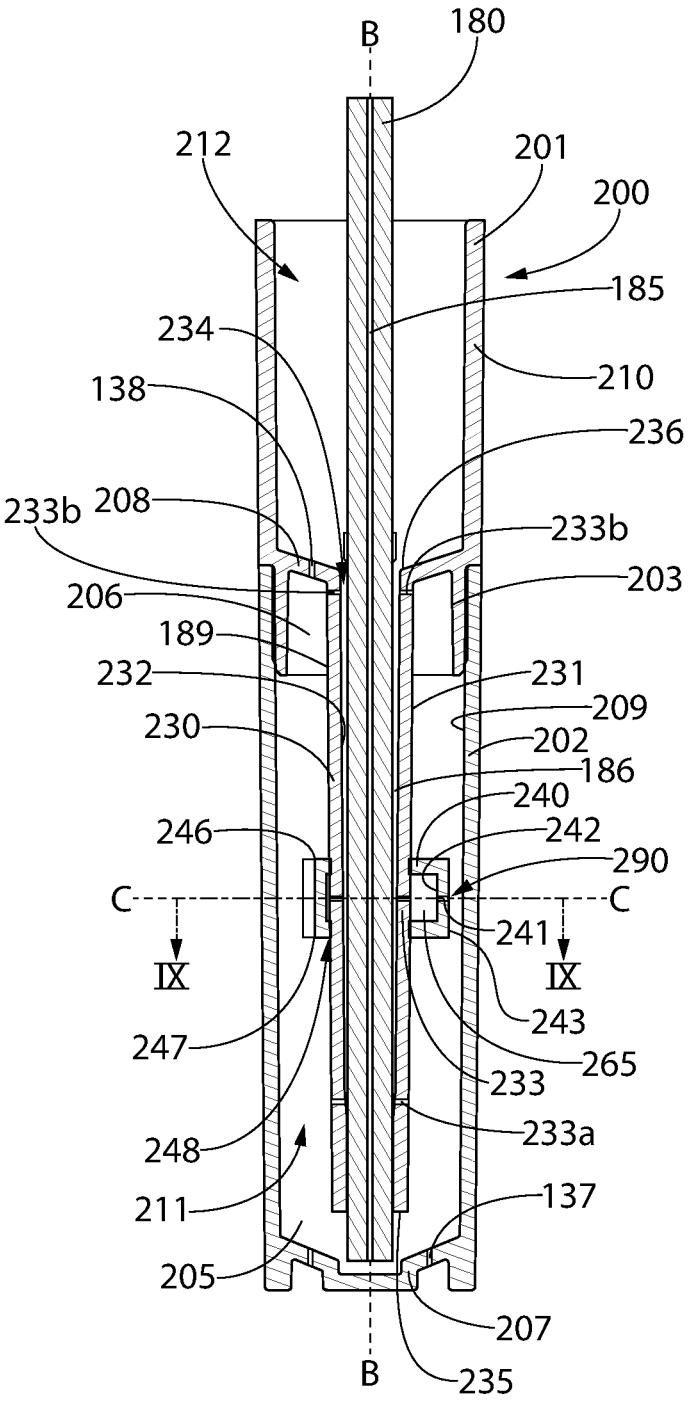
FIG. 7 is a cross-sectional view taken along line VII-VII in FIG. 6.
Figure 8A:
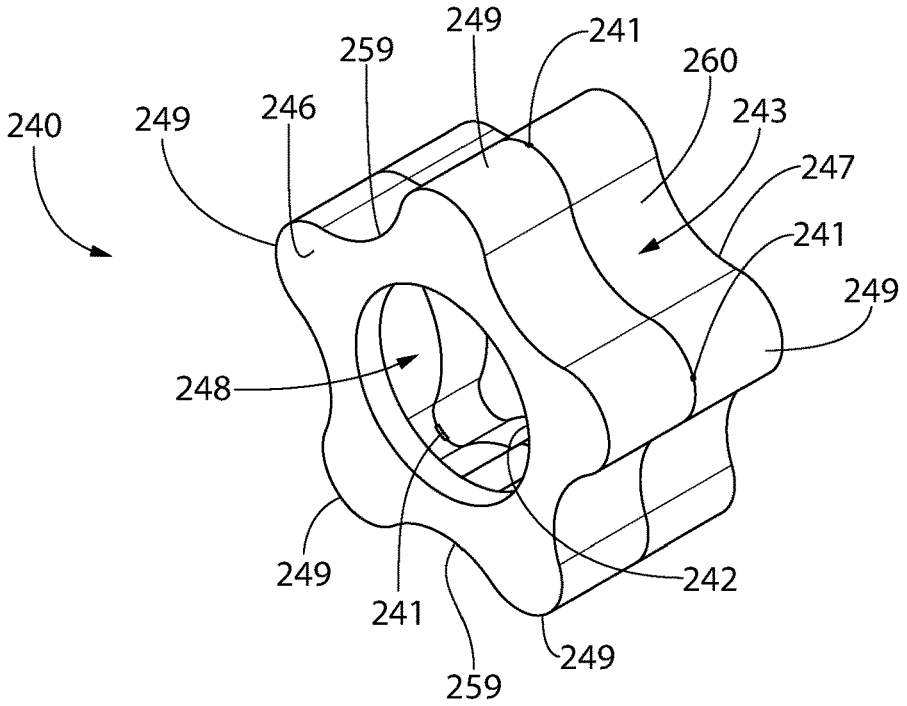
FIG. 8A is a perspective view of a portion of a hub component of the liquid supply apparatus of FIG. 3.
Figure 8B:
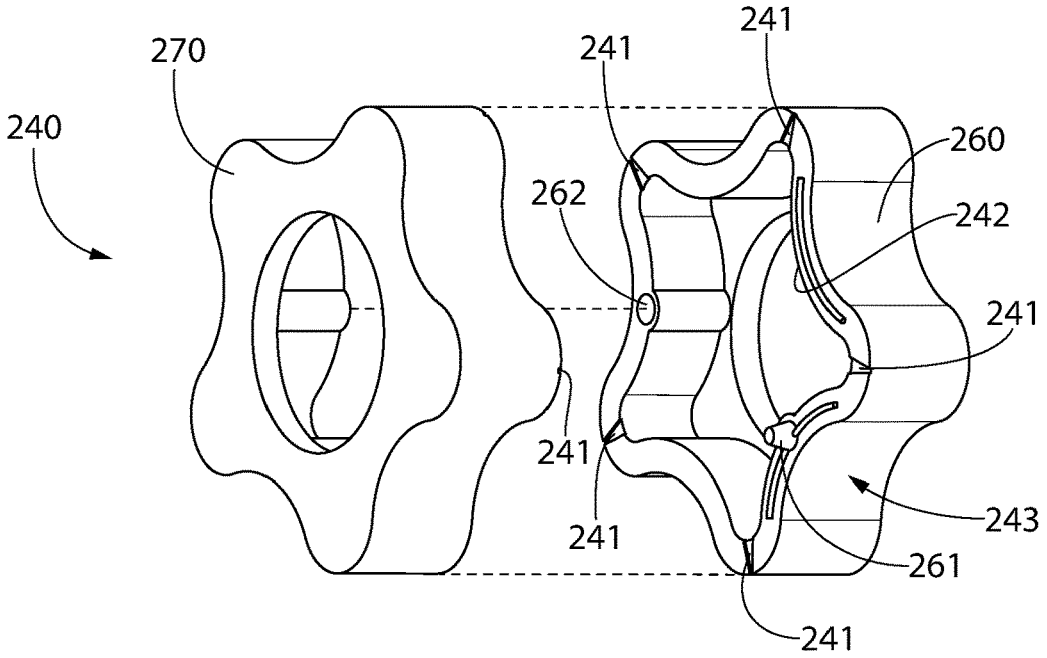
FIG. 8B is an exploded view of the hub component of FIG. 8A.
Figure 9:
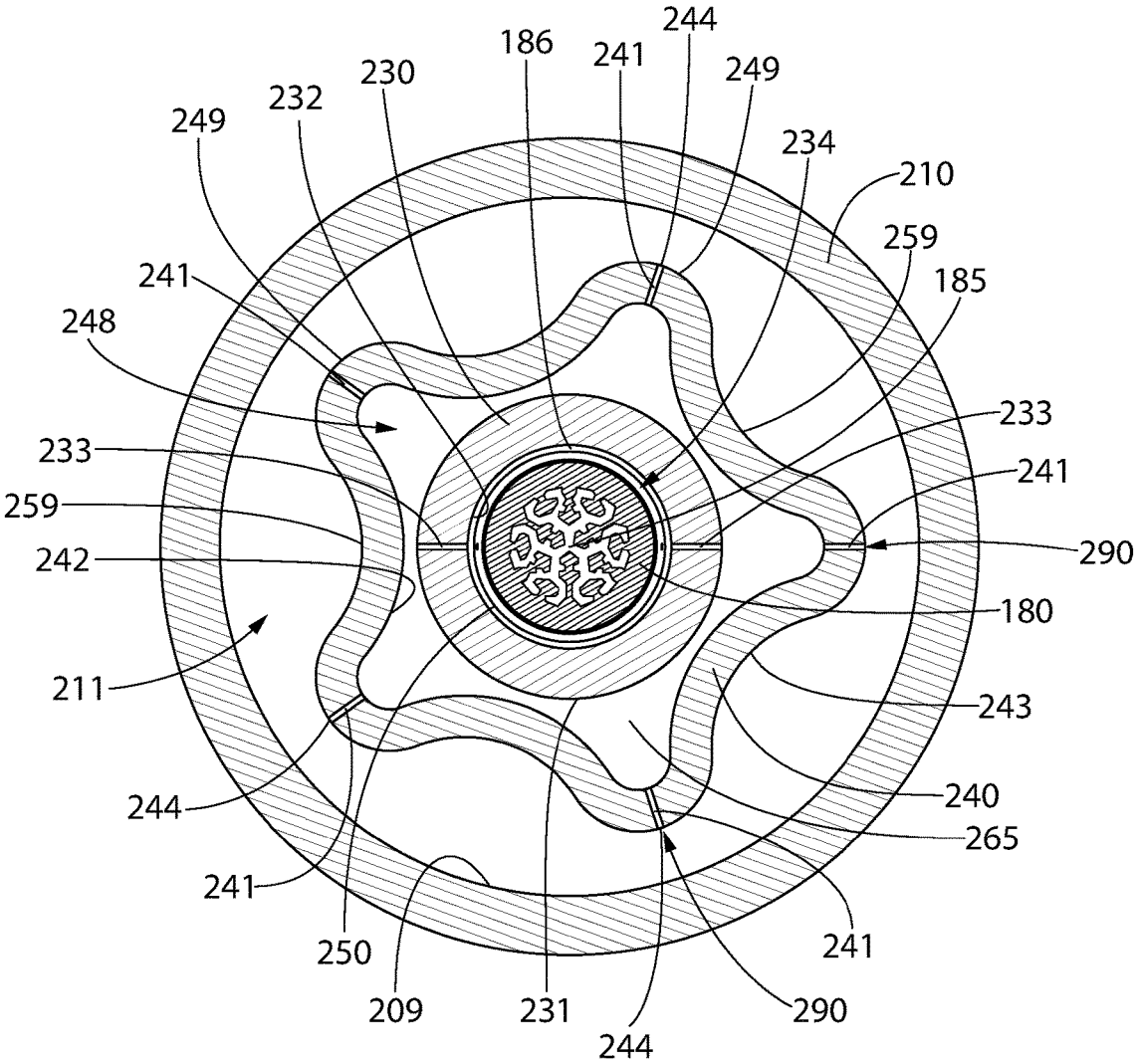
FIG. 9 is a cross-sectional view taken along line IX-IX in FIG. 7.

Referring to FIGS. 7-9, the hub component 240 will be further described. In the exemplified embodiment, the hub component 240 is formed of a first part 260 and a second part 270. The first part 260 has a protuberance 261 and a recess 262. The second part 270 has a similar protuberance and recess, although they are not visible on the illustrations of the second part 270 provided herewith. The protuberance 261 of the first part 260 mates with the recess of the second part 270 and the recess 262 of the first part 260 mates with the protuberance of the second part 270 to couple the first and second parts 260, 270 together. Of course, other mechanisms can be used to couple the first and second parts 260, 270 together in other embodiments. Furthermore, in still other embodiments the hub component 240 may be formed of a single part rather than two parts. Each of the first and second parts 260, 270 has cut-outs or notches therein such that when the first and second parts 260, 270 are coupled together, the cut-outs/notches are aligned to thereby form vent apertures 241 that extend from an outer side surface 243 of the hub component 240 to an inner surface 242 of the hub component 240. The vent apertures 241 of the hub component 240 and the vent apertures 233 of the vent tube 230 that are aligned with the hub component 240 as described herein each form a portion of a radial vent passageway 290 as described more fully herein below.

In the exemplified embodiment, the hub component 240 is in the shape of a five-sided star. However, the invention is not to be so limited and the hub component 240 may have other shapes so long as it achieves the function described herein. Specifically, the hub component 240 may be a star having less than five sides (i.e., three or four sides) or more than five sides (i.e., six sides, seven sides, eight sides, etc.). Alternatively, the hub component 240 could simply have a main body and a plurality of arms protruding from the main body in a radial manner such that each of the arms forms a venting passageway. In one embodiment, the hub component 240 may comprise a central portion and a spoke portion or a plurality of spoke portions such that the spoke portions form portions of the radial vent passageways. In another embodiment, the hub component 240 could simply comprise separate structures each defining a vent passageway from the storage cavity 211 to one of the vent apertures 233 of the vent tube 230 as described herein. Thus, it should be appreciated that although one specific embodiment for the hub component 240 is illustrated in the drawings, the invention is not to be particularly limited to the shape exemplified in all embodiments.

The hub component 240 comprises an inner surface 242, an outer side surface 243, an outer top surface 246, and an outer bottom surface 247. The hub component 240 comprises a plurality of the vent apertures 241 extending through the hub component 240 from the outer side surface 243 to the inner surface 243. Furthermore, the hub component 240 comprises a passageway 248 extending from the outer top surface 246 to the outer bottom surface 247. The hub component 240 may be mounted within the storage cavity 211 with the vent tube 230 located within and extending through the passageway 248. Thus, the hub component 240 may be mounted directly to the vent tube 230 in some embodiments. The hub component 240 may be mounted to the vent tube 230 using mechanical means, fasteners, adhesion, interference fit, protuberance/detent, or the like.

When the hub component 240 is mounted within the storage cavity 211, the vent apertures 241 are radially arranged about the cavity axis B-B of the storage cavity 211. Stated another way, each of the vent apertures 241 extends radially from the cavity axis B-B towards the inner surface 209 of the housing 210 in a spaced apart manner. Each of the vent apertures 241 of the hub component 240 terminates in a vent opening 244 at the outer side surface 243 of the hub component 240. The vent openings 244 are radially spaced from the cavity axis B-B and arranged in a spaced apart manner to circumferentially surround the cavity axis B-B. In one embodiment, all of the vent openings 244 are intersected by a single reference plane C-C that is orthogonal to the cavity axis B-B.

In one embodiment, the hub component 240 has a shape such that the outer side surface 243 undulates and comprises a plurality of apex portions 249 and a plurality of valley portions 259 such that one of the valley portions 259 is located between each pair of adjacent apex portions 249 and vice versa. The apex portions 249 of the hub component 240 are the portions of the hub component 240 that extend furthest from the cavity axis B-B when the hub component 240 is coupled to the vent tube 230 as described herein below. In the exemplified embodiment, the hub component 240 has five of the apex portions 249 and five of the valley portions 259 (hence the five-sided star) although more or less than five apex and valley portions 249, 259 are possible in other embodiments.

In the exemplified embodiment, the vent openings 244 are located at the outer side surface 243 of the hub component 240 at the apexes 249 of the hub component 240. Thus, the vent openings 244 are located adjacent to the inner surface 209 of the housing 210. In one embodiment, the distance between the vent openings 244 and the inner surface 209 of the housing 210 may be between 0.5 mm and 2.0 mm. Maintaining the vent openings 244 closely spaced to the inner surface 209 of the housing 210 ensures that at least one of the vent openings 244 is fluidly coupled to an air pocket within the storage cavity 211 when the housing 210 is in an orientation such that none of the other vents are fluidly coupled to the air pocket, as discussed in more detail below with reference to FIGS. 10A-10D. Thus, the vent apertures 241 of the hub component 240 and the vent apertures 233 and the passageway 234 of the vent tube 230 work cooperatively (as the radial vent passageways 290) to permit proper venting of the storage cavity 211 to ensure that the storage cavity 211 is vented to the external atmosphere regardless of the orientation of the housing 210.

Although described herein as being "radial," the radial vent passageways 290 need not be radial in a linear sense. Specifically, the term "radial" as referring to the radial vent passageways 290 merely means that the radial vent passageways 290 extend from a first point (i.e., at the openings 244 of the vent apertures 241) that is located a first distance from the cavity axis B-B to a second point (i.e., at the openings of the vent apertures 233 of the vent tube 230 at the inner surface 232 of the vent tube 230) that is located a second distance from the cavity axis B-B, the second distance being less than the first distance. Thus, this "radial" path may be linear, tortuous, or the like so long as it extends from a first point a first (greater)distance from the cavity axis B-B to a second point a second (lesser) distance from the cavity axis B-B).

The radial vent passageways 290, the vent apertures 233 that are not aligned with the hub component 240, and the additional vent apertures 137, 138 may be individually referred to herein as "vents" in some embodiments because each is able to vent air from the storage cavity 211 to the external atmosphere. Thus, when the term "vents" is used, it may be referring to any of one or more of the radial vent passageways 290, the vent apertures 233 that are not aligned with the hub component 240, and the additional vent apertures 137, 138.

The hub component 240 may be formed from any material desired, including rigid materials like plastic, wood, metal, or the like and more flexible materials like thermoplastic elastomers, rubbers, or the like. In some embodiments, the hub component 240 may be formed via an injection molding process. In other embodiments, the hub component 240 may be formed by a 3D printing or other additive manufacturing process.

In the exemplified embodiment, the hub component 240 is placed within the storage cavity 211 and mounted to the vent tube 230 so that a manifold chamber 265 is formed between the inner surface 242 of the hub component 240 and the outer surface 231 of the vent tube 230. The manifold chamber 265 may be an annular space that surrounds the vent tube 230 in some embodiments. The hub component 240 may be mounted to the vent tube 230 in a hermetically sealed manner so that air/gas that enters into the manifold chamber 265 can only exit the manifold chamber 265 via the vent apertures 233 in the vent tube 230 or the vent apertures 241 in the hub component 240.

In the exemplified embodiment, the vent apertures 241 of the hub component 240, the manifold chamber 265, and the vent apertures 233 of the vent tube 230 collectively form the radial vent passageways 290, which extend from the storage cavity 211 to the primary vent passageway 250. Although described herein as being "radial," in certain embodiments the radial vent passageways 290 do not extend in a perfectly linear/radial manner. Rather, the radial vent passageways 290 may form pathways between the vent apertures 241 of the hub component 240 and the vent apertures 233 of the vent tube 230 that are spatially coupled via the manifold chamber 265 but that are not circumferentially aligned with one another. The hub component 240 is coupled to the vent tube 230 at an axial location along the vent tube 230 such that at least one of the vent apertures 233 of the vent tube 230 is in fluid or spatial communication with the manifold chamber 265. As a result, air/gas can pass from the storage cavity 211 into the manifold chamber 265 via the vent apertures 241, from the manifold chamber 265 to the primary vent passageway 250 via the vent apertures 233, and then up the primary vent passageway 250 to the venting cavity 212 where it can flow to the external atmosphere as discussed more fully below.

As an alternative embodiment, the manifold chamber 265 may be omitted and the hub component 240 may be coupled to the vent tube 230 so that the vent apertures 241 in the hub component 240 are directly transversely aligned with the vent apertures 233 in the vent tube 230. In this alternative embodiment, the air/gas in the storage cavity 211 would pass from the storage cavity 211 and into the primary vent passageway 250 of the vent tube 230 via the vent apertures 241 of the hub component 240 and the vent apertures 233 of the vent tube 230 without passing into any intermediate chamber. However, including the manifold chamber 265 may be beneficial in that it allows for a greater degree of tolerance such that the vent apertures 241 of the hub component 240 do not need to be perfectly aligned with the vent apertures 233 of the vent tube 230 to permit proper functionality of the apparatus. Rather, the vent apertures 241 of the hub component 240 and the vent apertures 233 of the vent tube 230 need only be aligned with the manifold chamber 265.

As discussed in greater detail below with reference to FIGS. 10A-10D, the vents 290, 233, 137, 138 are positioned in such a manner that there are no pockets of trapped air within the storage cavity 211, regardless of orientation of the housing 210, that can expand due to increases in temperature or decreases in pressure (both of which would exert pressure on the liquid in the storage cavity 211 and cause it to be expelled in an uncontrolled manner). Rather, any air pockets are always spatially/fluidly coupled to the exterior atmosphere (via the vents 290, 233, 137, 138, the primary vent passageway 150, and the handle vent apertures 118, 119) so that as a result of any increases in temperature or decreases in pressure (i.e., expansion of the air/gas), the air/gas in the air pockets will exit the storage cavity 211 rather than exert pressure on the liquid and cause it to leak out of the storage cavity 211. In order to achieve this, at least one of the radial vent passageways 290 may be positioned along the housing 210 at a location that is aligned with a maximum internal diameter of the storage cavity 211.

In the exemplified embodiment, the hub component 240 is located in a middle axial section of the storage cavity 211 between the first and second ends 205, 206 thereof. However, the invention is not to be so limited in all embodiments and in certain embodiments, depending on the locations of the maximum diameter of the storage cavity 211, the hub component 240 may be positioned at other locations. Specifically, the maximum diameter region of the storage cavity 211 could be closer to the first or second ends 205, 206 of the storage cavity 211, and in such embodiments the location of the hub component 240 within the storage cavity 211 may change as well. As the orientation of the housing 210 changes, the liquid in the storage cavity 211 will move around and the location of the air pockets will change. However, air pockets that form will be located in the regions of the storage cavity 211 that has the maximum internal diameter. Thus, keeping the hub component 240 in alignment with the maximum internal diameter portion of the storage cavity 211 ensures that one of the radial vent passageways 290 is in spatial communication with gas/air pockets of the storage cavity 211.

The vents, which includes the radial vent passageways 290 (specifically the vent apertures 241 of the hub component 240 of the radial vent passageways 290), the vent apertures 233, 233*a*, 233*b* of the vent tube 230, and the additional vent apertures 137, 138, may be configured to prevent the liquid stored within the storage cavity 211 from passing therethrough at ambient temperature and with a pressure equilibrium existing between the storage cavity 211 and the external atmosphere while permitting air/gas within the storage cavity 211 to pass therethrough. Specifically, the vent apertures 241, 233, 233*a*, 233*b*, 137, 138 permit air/gas to pass therethrough to vent the storage cavity 211 so that as air expands it passes to the exterior atmosphere rather than putting pressure on the liquid in the storage cavity 211 which could create a leak. Specifically, as long as the vent apertures 241, 233, 233*a*, 233*b*, 137, 138 are not clogged, the gas/air will be capable of freely passing through the vent apertures 241, 233, 137, 138 both into and out of the storage cavity 211 as needed (during periods of compression and expansion or the gas) to provide proper air intake and venting to ensure proper operation of the device (i.e., consistent liquid flow during use) without leakage. At the same time, the vent apertures 241, 233, 233*a*, 233*b*, 137, 138 are designed to prevent the liquid from passing therethrough because this could create a leak situation.

There are several ways that the vent apertures 241, 233, 233*a*, 233*b*, 137, 138 can be configured to achieve the functionality of permitting air/gas to pass therethrough while preventing liquid from passing therethrough. First, this may be accomplished by specifically selecting the dimensions of the vent apertures 241, 233, 233*a*, 233*b*, 137, 138, based on the viscosity and surface tension of the liquid, to ensure that the liquid cannot pass through the vent apertures 241, 233, 233*a*, 233*b*, 137, 138 under the conditions noted above. For example without limitation, in one embodiment the vent apertures 241, 233, 233*a*, 233*b*, 137, 138 may have a diameter in a range of 0.05 mm and 0.5 mm, and more specifically in a range of 0.1 mm and 0.3 mm. Alternatively, the vent apertures 241, 233, 233*a*, 233*b*, 137, 138 may be covered with a selective membrane that permits gas/air to pass therethrough in both directions while preventing the liquid from passing therethrough. In other embodiments, the material of the structure that forms the vent apertures 241, 233, 233*a*, 233*b*, 137, 138 may be selected to prevent the liquid from passing therethrough while permitting gas/air to pass therethrough (hydrophobic versus hydrophilic). Still further, the walls that define/surround the vent apertures 241, 233, 233*a*, 233*b*, 137, 138 may have a jagged shape or the like that prevents liquid from passing therethrough under the conditions identified above. Thus, there are many different ways that the vent apertures 241, 233, 233*a*, 233*b*, 137, 138 can be configured to permit air to flow therethrough while preventing liquid from passing therethrough at ambient temperature and with a pressure equilibrium existing as noted above.

The hub component 240 and its vent apertures 241 along with the vent apertures 233 of the vent tube 230 and the additional vent apertures 137, 138 described herein operates as an air intake and venting system to allow air to replace the liquid that is dispensed from the storage cavity 211 over time during use. Specifically, each of the radial vent passageways 290 forms a pathway from the storage cavity 211 to the primary vent passageway 250 of the vent tube 230, and the primary vent passageway 250 forms a pathway from each of the radial vent passageways 290 to the external atmosphere as described in more detail below. Similarly, the vent apertures 233*a*, 233*b* that are not aligned with the hub component 240 form a pathway from the storage cavity 211 to the primary vent passageway 250. Furthermore, the vent aperture 137 forms a pathway from the storage cavity 211 to the external atmosphere via a handle vent aperture 118 and the vent aperture 138 forms a pathway from the storage cavity 211 to the venting cavity 212 and the handle vent aperture 119 forms a pathway from the venting cavity 212 to the external passageway. The shape of the hub component 240, and specifically the fact that it has apexes 249 on which the vent openings 244 of the vent apertures 241 are located in a closely spaced manner relative to the inner surface 209 of the housing 210, ensures that the air pockets in the storage cavity 211 are always vented to the external atmosphere regardless of the orientation (inclination and rotational) of the housing 210. This helps to ensure consistent flow of the liquid during use and prevents uncontrolled liquid leakage regardless of the orientation at which the housing 210 is positioned and regardless of changes in temperature and pressure.

In some embodiments, the upper vent aperture 233*b* and the vent aperture 138 permit proper venting of the storage cavity 211 when the housing 210 is in an upright orientation and the vent openings 244, the lower vent aperture 233*a*, and the vent aperture 137 are submerged by the liquid in the storage cavity 211. The lower vent aperture 137 permits proper venting of the storage cavity 211 when the housing 210 is in a vertical but inverted orientation and the vent openings 244, the upper/lower vent aperture 233*a*, 233*b*, and the vent aperture 138 are submerged by the liquid in the storage cavity 211. The plurality of radial vent passageways 290 permit proper venting of the storage cavity 211 when all of the other vent apertures are submerged by the liquid in the storage cavity 211 but at least one of the plurality of vent apertures 241, and specifically its associated vent opening 244, remains outside of the liquid in the storage cavity 211. In every instance that the vent apertures 137, 138 are covered by the liquid in the storage cavity 211, regardless of the specific orientation of the housing 210, at least one of the vent openings 244 of the vent apertures 241 will be located outside of the liquid so that it is spatially coupled to the gas within the storage cavity 211. Thus, in certain embodiments, regardless of the orientation of the housing 210 there remains one vent available for venting the storage cavity 211 which assists in preventing liquid leaks.

In the exemplified embodiment, a passageway exists from the storage cavity 211 to the external atmosphere as follows: (1) from the storage cavity 211 through the vent aperture 137 and then through the handle vent aperture 118 to the external atmosphere; (2) from the storage cavity 211 through the vent aperture 138 to the venting cavity 212, and from the venting cavity 212 to the external atmosphere via the handle vent aperture 119; (3) from the storage cavity 211 through one of the vent apertures 233*a*, 233*b* in the vent tube 230 to the primary vent passageway 250, from the primary vent passageway 250 to the venting cavity 212, and from the venting cavity 212 to the external atmosphere via the handle vent aperture 119; and (4) from the storage cavity 211 through one of the radial vent passageways 290 (i.e., through one of the vent openings 244 into one of the vent apertures 241, from the vent aperture 241 into the manifold chamber 265 and then into one of the vent apertures 233 in the vent tube 230 to the primary vent passageway 250), and from there to the venting cavity 212 and to the external atmosphere via the handle vent aperture 119.

Referring now to FIGS. 10A-10D, operation of the liquid supply apparatus 200 of the personal care implement 100 will be described. It should be appreciated that the functionality described herein can be utilized with a stand-alone cartridge that operates independently or upon insertion into the handle cavity 170 of a personal care implement 100 as described above. In certain embodiments, the vents are located and arranged such that irrespective of the vertical and angular orientation of the housing 210 relative to a gravitational vector GV, at least one of the vents is in spatial communication with a gas 109 located within the storage cavity 211 of the housing 210 rather than with a liquid 108 located within the storage cavity 211 of the housing 210. As used herein, the gravitational vector GV is a vector illustrating the direction of the force of gravity applied to the housing 210 at a given orientation of the housing 210.

Figure 10A:
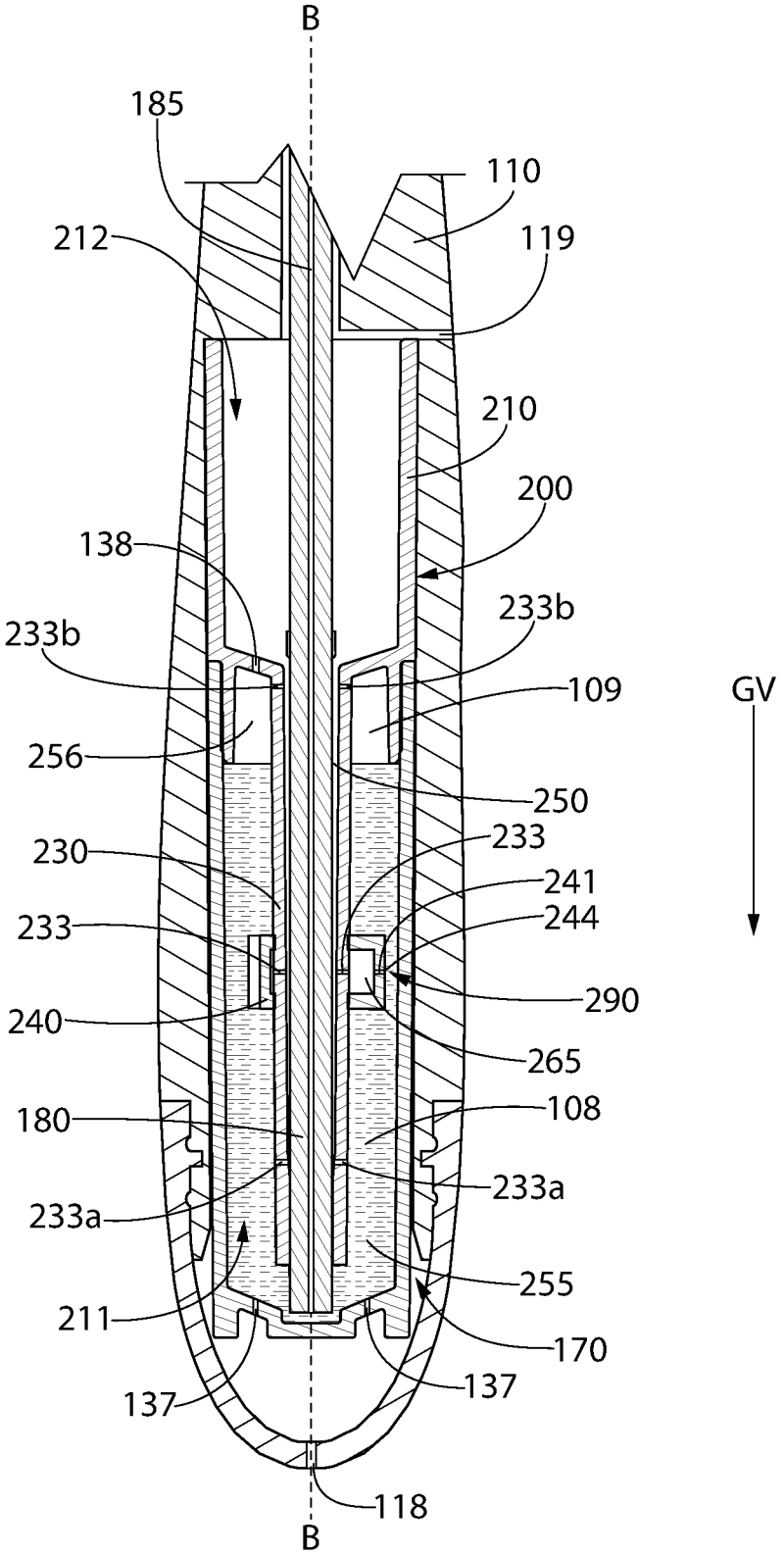
FIG. 10A is a close-up view of area X of FIG. 5 with liquid in a storage cavity of the liquid supply apparatus and with the personal care implement in a first orientation.

FIG. 10A illustrates the housing 210 positioned in an upright orientation. As shown here, the storage cavity 211 of the housing 210 has a total volume that is occupied by the liquid 108 and the gas 109. Thus, the total volume of the storage cavity 211 is occupied collectively by the liquid 108 and the gas 109.

In the exemplified embodiment, a first portion of the total volume of the storage cavity 211 of the housing 210 is occupied by the liquid 108 and a second portion of the total volume of the storage cavity 211 of the housing 210 is occupied by the gas 109. In the exemplified embodiment, the first portion of the total volume of the storage cavity 211 that is occupied by the liquid 108 is a majority of the total volume such that the liquid occupies a majority of the total volume of the storage cavity 211. In one embodiment, the liquid 108 occupies at least eighty percent (80%) of the total volume of the storage cavity 211. In another embodiment, the liquid 108 occupies at least eight-five percent (85%), or at least ninety percent (90%) or at least ninety-five percent (95%) of the total volume of the storage cavity 211. Of course, as the liquid 108 is dispensed during use of the device, the liquid 108 contained within the storage cavity 211 becomes depleted and the percentage of the total volume that is taken up by the liquid 108 decreases while the percentage of the total volume that is taken up by the gas 109 increases. This results in increased venting because more of the vents are in spatial communication with the gas 109 than the liquid 108 as the liquid 108 becomes depleted and takes up less of the total volume of the storage cavity 211.

In one specific embodiment, the total volume of the storage cavity 211 may be between 5 ml and 10 ml, more specifically between 6 ml and 8 ml, and still more specifically approximately 7 ml. Furthermore, in certain embodiments prior to use the liquid 108 will encompass approximately 95% (about 6.7 ml when the total volume is 7 ml) of the total volume. Of that 6.7 ml of the liquid 108, a portion will prime the capillary member 180 and the applicator 150, leaving approximately 6 ml of the liquid 108 within the storage cavity 211 (based on the storage cavity 211 having a total volume of 7 ml, the exact numbers may change while the percentages may remain the same). Thus, after priming and at or before first use by an end user, between 80%-90%, and more specifically approximately 85% of the total volume of the storage cavity 211 will be taken up by the liquid 108, the remaining 10%-20%, and more specifically 15%, being taken up by the gas/air 109.

With the housing 210 positioned in the upright orientation such that the gravitational vector GV is parallel to the cavity axis B-B, the liquid 108 in the storage cavity 211 is located in a bottom portion 255 of the storage cavity 211 and the gas 109 is located in a top portion 256 of the storage cavity 211 above the free surface of the liquid 108. In this example and orientation of the housing 210, the upper vent apertures 233*b* of the vent tube 200 and the vent opening 138 are in spatial communication with the gas 109 in the storage cavity 211 while the lower vent apertures 233*a*, the vent aperture 137, and the vent apertures 241 of the hub component 240 of the radial vent passageways 290 are submerged in the liquid 108. Thus, if there were an increase in temperature or a decrease in pressure, the gas 109 will flow out of the storage cavity 211 in at least one of the following manners: (1) through the vent aperture 138 to the venting cavity 212, and from the venting cavity 212 to the external environment via the handle vent aperture 119; and (2) through the upper vent apertures 233*b* of the vent tube 200 to the primary vent passageway 250, from the primary vent passageway 250 to the venting cavity 212, and from the venting cavity 212 to the external environment via the handle vent aperture 119. Thus, because the upper vent apertures 233*b* of the vent tube 230 and/or the vent opening 138 are in spatial communication with the gas 109 (i.e., air pocket) within the storage cavity 211, the gas 109 is permitted to pass to the external atmosphere rather than having it exert a pressure on the liquid 108 which could create a leak situation.

In certain embodiments, either the upper vent apertures 233*b* of the vent tube 230 or the vent opening 138 could be omitted. Thus, in some embodiments there may only be one vent aperture available for the gas 109 to vent through when the housing 210 is in the upright vertical orientation illustrated in FIG. 10A. However, including both the upper vent apertures 233*b* of the vent tube 230 and the vent opening 138 may be preferable in some embodiments for redundancy and may be beneficial because even if one of them becomes clogged operation will not be affected.

In certain embodiments, the gas 109 in the storage cavity 211 is air (i.e., oxygen, a mixture of oxygen, nitrogen, and small amounts of other gases, or the like). Furthermore, the liquid 109 can be any liquid that is desired to be dispensed for application to a surface (such as a biological surface) depending on the end use. For example, when the desired application site is a user's oral cavity, the liquid 108 may be one that provides a benefit to a user's oral surfaces (i.e., a benefit agent) such as a sensorial or therapeutic benefit. For example without limitation, the liquid 108 may be a mouthwash, a dentifrice, a tooth whitening agent such as peroxide containing tooth whitening compositions, or the like. Other contemplated liquids that can be stored in the storage cavity 211 include, for example without limitation, antibacterial agents; oxidative or whitening agents; enamel strengthening or repair agents; tooth erosion preventing agents; tooth sensitivity ingredients; gum health actives; nutritional ingredients; tartar control or anti-stain ingredients; enzymes; sensate ingredients; flavors or flavor ingredients; breath freshening ingredients; oral malodor reducing agents; anti-attachment agents or sealants; diagnostic solutions; occluding agents, dry mouth relief ingredients; catalysts to enhance the activity of any of these agents; colorants or aesthetic ingredients; and combinations thereof. In certain embodiments the oral care material is free of (i.e., is not) toothpaste. Instead, the oral care material in such embodiments is intended to provide benefits in addition to merely brushing one's teeth. Other suitable oral care materials could include lip balm or other materials that are typically available in a semi-solid state. Furthermore, in still other embodiments the first liquid 103 can be a natural ingredient, such as for example without limitation, lotus seed; lotus flower, bamboo salt; jasmine; corn mint; camellia; aloe; gingko; tea tree oil; xylitol; sea salt; vitamin C; ginger; cactus; baking soda; pine tree salt; green tea; white pearl; black pearl; charcoal powder; nephrite or jade and Ag/Au+.

Thus, when the liquid 108 is stored in an oral care implement or toothbrush, any of the above liquids may be desirable for use as the liquid 108. In other embodiments the personal care implement 100 may not be a toothbrush. Thus, the liquid 108 can be any other type of liquid that has beneficial results when dispensed in accordance with its end use or the end use of the product/implement with which it is associated. For example, the liquid 108 may be hair gel when the implement is a hairbrush, make-up (i.e., mascara or the like) when the implement is a make-up applicator, shaving cream when the implement is a razor, anti-acne cream when the implement is a skin or face scrubber, or the like. Furthermore, as described herein in some embodiments the liquid supply apparatus 1000 may not be associated with a personal care implement at all. Thus, the liquid 108 may be modified to be any type of liquid that is desired to be dispensed in accordance with the teachings set forth herein even if it is dispensed directly from the liquid supply apparatus 1000 rather than through a personal care implement 100.

Figure 10B:
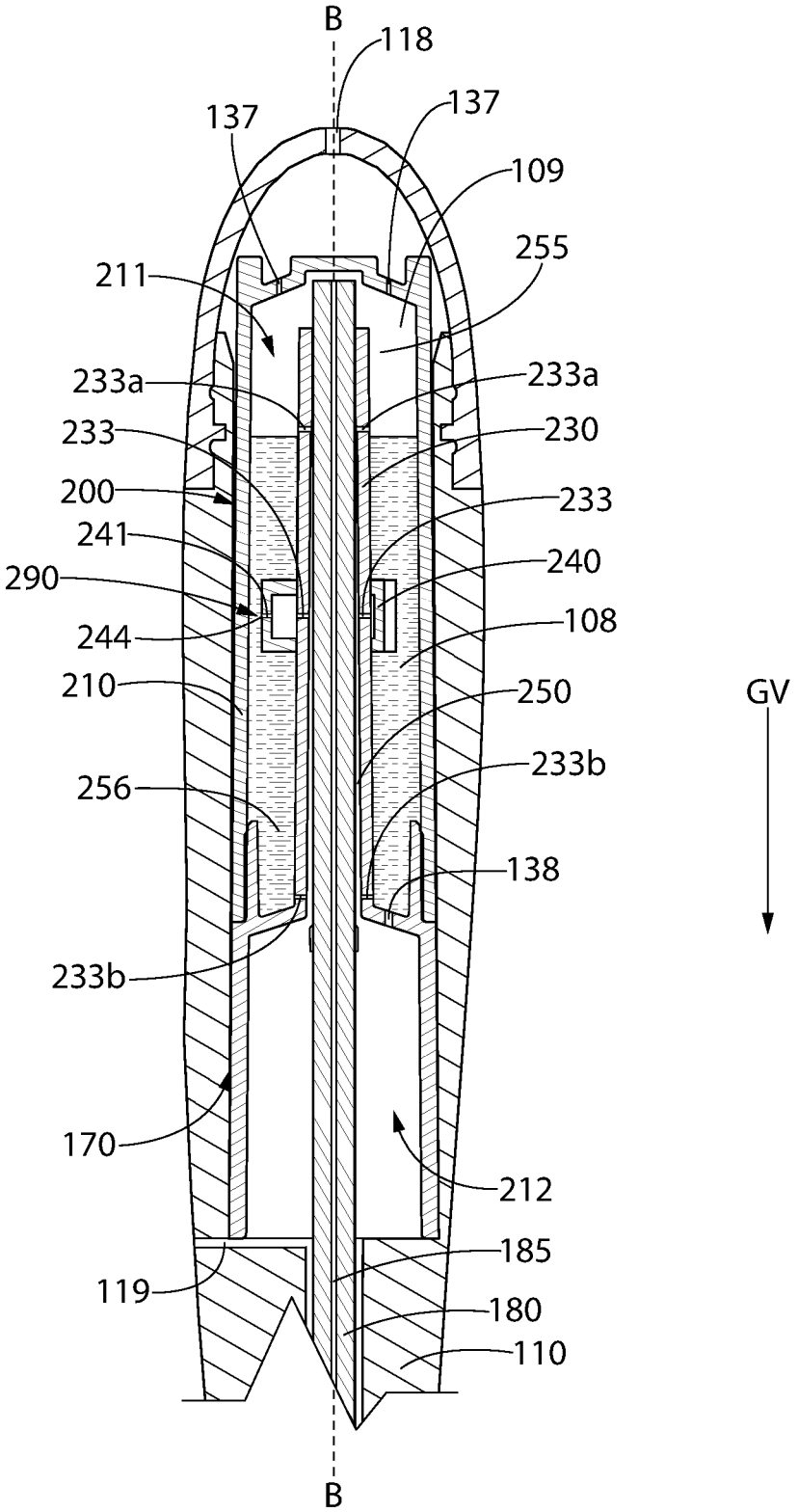
FIG. 10B is a close-up view of area X of FIG. 5 with liquid in the storage cavity of the liquid supply apparatus and with the personal care implement in a second orientation.

FIG. 10B illustrates the same thing as FIG. 10A except the housing 210 has been flipped 180° so that it is upside-down relative to FIG. 10A. Thus, in this embodiment the cavity axis B-B remains parallel to the gravitational vector GV, except here the housing 210 is in an upside-down vertical orientation such that the top portion 256 of the storage cavity 211 is facing downward and the bottom portion 255 of the storage cavity is facing upward. In this embodiment, the same amount of the total volume of the storage cavity 211 is occupied by the liquid 108 and the gas 109 as with the embodiment of FIG. 10A (i.e., a majority of the total volume is occupied by the liquid 108 and the remainder by the gas 109).

With the housing 210 positioned in the upside-down vertical orientation, the liquid 108 in the storage cavity 211 is located in the top portion 256 of the storage cavity 211 (which faces downward) and the gas 109 is located in the bottom portion 255 of the storage cavity 211 (which is above the free surface of the liquid 108 due to the upside-down orientation). In this example and orientation of the housing 210, the vent aperture 137 is in spatial communication (i.e., fluidly coupled) with the gas 109 in the storage cavity 211 while the vent apertures 233 of the vent tube 230, the vent apertures 241 of the hub component 240 of the radial vent passageways 290, and the vent aperture 138 are submerged in the liquid 108. Thus, if there were an increase in temperature or a decrease in pressure, the gas 109 will flow out of the storage cavity 211 through the vent aperture 137 and then through the handle vent aperture 118. Thus, because the vent aperture 137 is in spatial communication with the gas 109 (i.e., air pocket) within the storage cavity 211, the gas 109 is permitted to pass to the external atmosphere rather than having it exert a pressure on the liquid 108 which could create a leak situation.

Furthermore, in this orientation the lower vent aperture 233*a* is also in spatial communication with the gas 109 in the storage cavity 211. Thus, if there were an increase in temperature or a decrease in pressure, the gas 109 can also flow out of the storage cavity 211 through the lower vent aperture 233*a* and into the primary vent passageway 250 of the vent tube 230, from the primary vent passageway 250 to the venting cavity 212, and from the venting cavity 212 to the external atmosphere via the handle vent aperture 119.

In certain embodiments, either the vent aperture 137 or the lower vent aperture 233*a* of the vent tube 230 could be omitted. Thus, there only needs to be one vent aperture available for the gas 109 to vent through when the housing 210 is in the upside-down vertical orientation illustrated in FIG. 10B. However, including both the vent aperture 137 and the lower vent aperture 233*a* of the vent tube 230 may be preferable in some embodiments for redundancy and may be beneficial because even if one of them becomes clogged operation will not be affected.

Figure 10C:
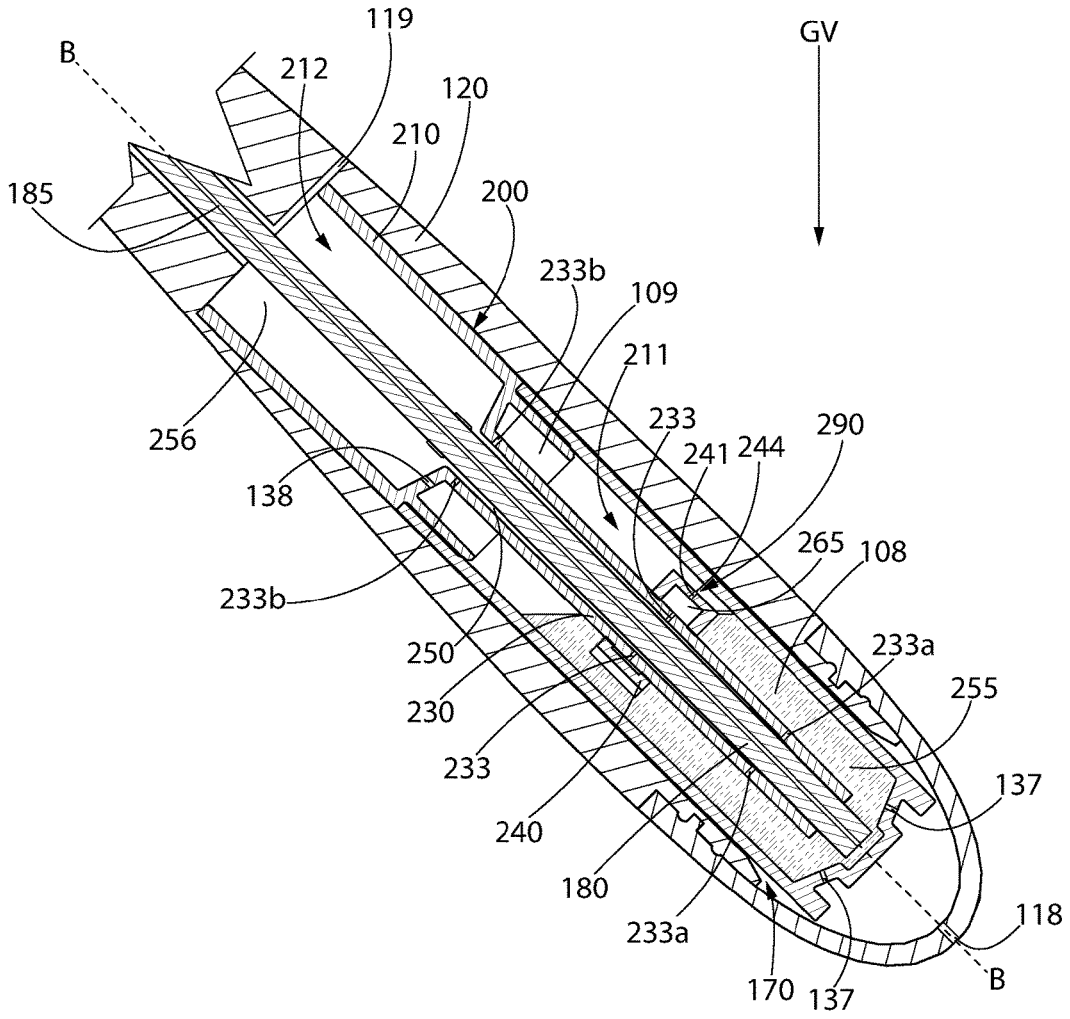
FIG. 10C is a close-up view of area X of FIG. 5 with liquid in the storage cavity of the liquid supply apparatus and with the personal care implement in a third orientation.

FIG. 10C illustrates the same thing as FIGS. 10A and 10B except the housing 210 has been tilted so that the cavity axis B-B is oriented obliquely to the gravitational vector GV. Although one specific tilt orientation is illustrated in FIG. 10C, the device will operate similarly in any of the infinite tilt orientations or inclinations at which the cavity axis B-B is oblique to the gravitational vector GV. Furthermore, at any orientation shown (including those shown in any of FIGS. 10A-10D and any of the other infinite orientations), the housing 210 can be rotated (with the cavity axis B-B as the rotational axis) 360° with the device still properly functioning to prevent a leak situation. In the embodiment of FIG. 10C, there is less of the liquid 108 in the storage cavity 211 than in the embodiments of FIGS. 10A and 10B to illustrate the vent apertures 241 of the hub component 240 (i.e., the radial vent passageways 290) being in spatial communication with the gas 109 in the storage cavity 211 as discussed below.

With the housing 210 positioned in this tilted orientation and the liquid level as shown, the gas 109 in the storage cavity 211 is located in the top portion 256 of the storage cavity 211. In this example and orientation of the housing 210, in addition to the upper vent aperture 233*b* of the vent tube 230 and the vent opening 138 being in spatial communication with the gas 109 in the storage cavity 211 (which was discussed above with reference to FIG. 10A), at least one of the vent apertures 241 (and its corresponding vent opening 244) of one of the radial vent passageways 290 is also in spatial communication with the gas 109 in the storage cavity 211. Thus, if there were an increase in temperature or a decrease in pressure, in addition to being able to flow out of the storage cavity 211 to the external atmosphere through the upper vent aperture 233*b* and/or the vent opening 138 as discussed above with reference to FIG. 10A, the gas 109 will also be able to flow out of the storage cavity 211 through one of the radial vent passageways 290 via its corresponding vent aperture 241. Specifically, as an additional route, the gas 109 could flow from the storage cavity 211 through one or more of the vent apertures 241 (via its respective vent opening 244) into the manifold chamber 265, from the manifold chamber 265 to the primary vent passageway 250 via one of the vent apertures 233 of the vent tube 230 (the above being equivalent to flowing form the storage cavity 211 through one of the radial vent passageways 290 to the primary vent passageway 250), from primary vent passageway 250 of the vent tube 230 into the venting cavity 212, and then from the venting cavity 212 to the external atmosphere via the handle vent aperture 119.

Figure 10D:
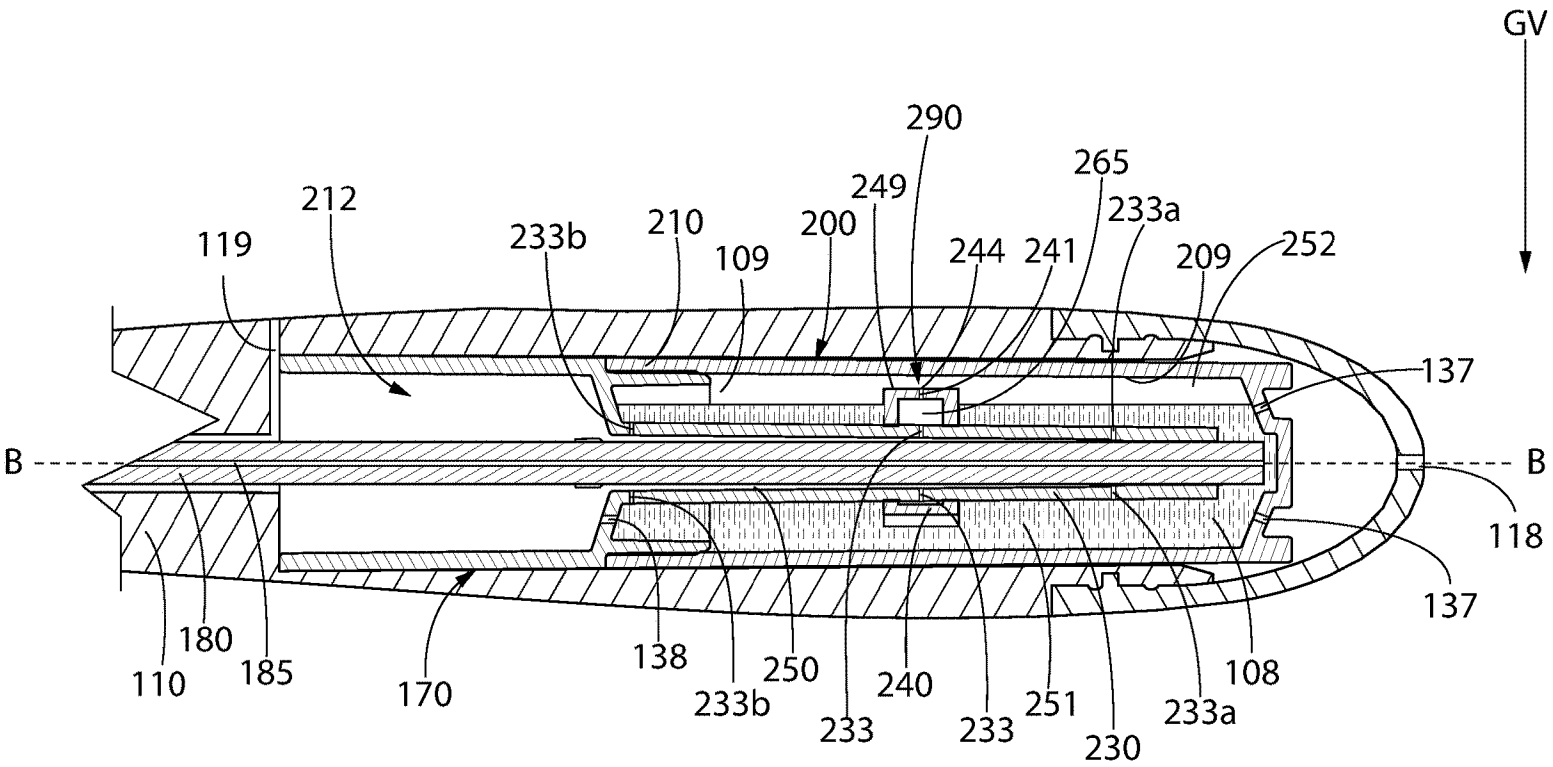
FIG. 10D is a close-up view of area X of FIG. 5 with liquid in the storage cavity of the liquid supply apparatus and with the personal care implement in a fourth orientation.

FIG. 10D illustrates the same thing as FIGS. 10A-10C except the housing 210 has been tilted so that the cavity axis B-B is oriented orthogonal to the gravitational vector GV. With the housing 210 positioned in this orientation, the liquid 108 in the storage cavity 211 falls by gravity to the left-side portion 251 of the storage cavity 211 (illustrated as the bottom due to the orientation of the housing 210 in FIG. 10D) and the right-side portion 252 of the storage cavity 211 (illustrated as the top due to the orientation of the housing in FIG. 10D) is filled with the gas 109. In this example and orientation of the housing 210, the vent apertures 233*a*, 233*b*, of the vent tube 230 and the vent apertures 137, and 138 are all submerged in the liquid 108 and thus are not in spatial communication with the gas 109 in the storage cavity 211.

However, in this orientation of the housing 210, at least one of the radial vent passageways 290, via its corresponding vent aperture 241 (and its respective vent opening 244) is in spatial communication with the gas 109 in the storage cavity 211. This occurs due to the fact that the vent openings 244 of the vent apertures 241 are located at the apex 249 of the hub component 240. Thus, the vent openings 244 are located adjacent and near to the inner surface 209 of the housing 210 to ensure that at least one of the vent openings 244 and its associated vent aperture 241 is in spatial communication with the gas 109 in the storage cavity 211.

Thus, with the housing 210 in the horizontal orientation of FIG. 10D, if there were an increase in temperature or a decrease in pressure, the gas 109 will expand and flow out of the storage cavity 211 into the vent aperture 241 via the vent opening 244, from the vent aperture 241 to the manifold chamber 265, from the manifold chamber 265 into the primary vent passageway 250 of the vent tube 230 via the vent aperture 233 of the vent tube 230 (the above being equivalent to flowing form the storage cavity 211 through one of the radial vent passageways 290 to the primary vent passageway 250), from the primary vent passageway 250 to the venting cavity 212, and from the venting cavity 212 to the external atmosphere via the handle vent aperture 119. Thus, because one of the vent apertures 241 is in spatial communication with the gas 109 (i.e., air pocket) within the storage cavity 211, the gas 109 is permitted to pass to the external atmosphere rather than having it exert a pressure on the liquid 108 which could create a leak situation.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A liquid supply apparatus comprising:

a housing defining a storage cavity having a total volume, the storage cavity extending along a cavity axis from a first end to a second end;

a store of a liquid in the storage cavity and occupying a portion of the total volume, a remaining portion of the total volume occupied by a gas;

a capillary member in liquid coupling with the store of the liquid, the capillary member extending through the housing and configured to transport the liquid from the store to an external atmosphere via capillary action;

a plurality of vents, each of the vents configured such that the liquid cannot flow therethrough at ambient temperature and pressure equilibrium between the storage cavity and the external atmosphere, the vents comprising a plurality of radial vent passageways;

a hub component mounted within the storage cavity;

the hub component comprising the radial vent passageways, each of the radial vent passageways extending between the storage cavity and a primary vent passageway, the primary vent passageway forming a pathway between each of the radial vent passageways and the external atmosphere; and the vents located and arranged such that irrespective of inclination and rotational orientation of the housing relative to a gravitational vector at least one of the vents is in liquid communication with the gas.

2. The liquid supply apparatus according to claim 1 wherein the store of the liquid occupies a majority of the total volume.

3. The liquid supply apparatus according to claim 1 wherein each of the radial vent passageways terminate in a vent opening, the vent openings radially spaced from the cavity axis and arranged in a spaced apart manner to circumferentially surround the cavity axis, wherein the vent openings are located adjacent a sidewall of the housing.

4. The liquid supply apparatus according to claim 3 wherein the vent openings are located on an outer side surface of the hub component, wherein each of the vent openings is located on an apex portion of the hub component, and wherein each of the vent openings is intersected by a reference plane that is orthogonal to the cavity axis.

5. The liquid supply apparatus according to claim 1 wherein the hub component comprises a central portion and a spoke portion.

6. The liquid supply apparatus according to claim 1 further comprising a vent tube, the vent tube comprising the primary vent passageway, wherein the hub component is mounted to the vent tube, and wherein the vent tube comprises a portion of at least one of the radial vent passageways.

7. The liquid supply apparatus according to claim 6 wherein the housing comprises a first housing component and a second housing component, the first housing component comprising the vent tube, the first housing component coupled to the second housing component so that the vent tube extends into the second housing component.

8. The liquid supply apparatus according to claim 6 wherein the capillary member extends though the vent tube and a portion of the capillary member protrudes from a distal end of the vent tube, wherein the capillary member is disposed within the primary vent passageway, and wherein an annular gap exists between an outer surface of the capillary member and an inner surface of the vent tube, the annular gap forming the pathway between each of the radial vent passageways and the external atmosphere.

9. The liquid supply apparatus according to claim 1 wherein the hub component comprises a manifold chamber, the manifold chamber forming a portion of the radial passageways.

10. An oral care implement comprising the liquid supply apparatus according to claim 1, the oral care implement comprising a head, a handle, and an applicator in fluid coupling with the capillary memner, wherein the applicator is located on the head.

11. The oral care implement according to claim 10 wherein the housing forms a portion of the handle.

12. The oral care implement according to claim 10 wherein the housing is disposed within a handle cavity of the handle.

13. A liquid supply apparatus comprising:

a housing defining a storage cavity extending along a cavity axis from a first end to a second end;

a capillary member extending through the housing and configured to transport liquid via capillary action;

a hub component mounted within the storage cavity, the hub component comprising radial vent passageways, each of the radial vent passageways extending between the storage cavity and a primary vent passageway, the primary vent passageway forming a pathway between each of the radial vent passageways and an external atmosphere;

at least one upper vent adjacent the first end of the storage cavity; and at least one lower vent located adjacent the second end of the storage cavity.

14. The liquid supply apparatus according to claim 13 wherein each of the radial vent passageways terminate in a vent opening, the vent openings radially spaced from the cavity axis and arranged in a spaced apart manner to circumferentially surround the cavity axis.

15. The liquid supply apparatus according to claim 13 wherein each of the vent openings is located on an apex portion of the hub component.

16. The liquid supply apparatus according to claim 13 further comprising a vent tube, the vent tube comprising the primary vent passageway, wherein the hub component is mounted to the vent tube.

17. The liquid supply apparatus according to claim 16 wherein the vent tube comprises a portion of at least one of the radial vent passageways.

18. The liquid supply apparatus according to claim 16 wherein the upper vent is located either in the vent tube or in a first end wall of the housing.

19. The liquid supply apparatus according to claim 16 wherein the housing comprises a first housing component and a second housing component, the first housing component comprising the vent tube, the first housing component coupled to the second housing component so that the vent tube extends into the second housing component.

20. The liquid supply apparatus according to claim 13 wherein the hub component comprises a manifold chamber, the manifold chamber forming a portion of each of the radial passageways.

* * * * *